US009399543B2

(12) United States Patent
Longley et al.

(10) Patent No.: US 9,399,543 B2
(45) Date of Patent: Jul. 26, 2016

(54) AUTOMATED PHARMACY SYSTEM FOR DISPENSING UNIT DOSES OF PHARMACEUTICALS AND THE LIKE

(71) Applicant: Parata Systems, LLC, Durham, NC (US)

(72) Inventors: Mark Longley, Raleigh, NC (US); Bradley Kenneth Smith, Cary, NC (US); Craig Steven Davis, Morrisville, NC (US); Matthew P. Daniels, Pittsboro, NC (US); George Raymond Abrams, Jr., Cary, NC (US); Mark I. Perisich, Raleigh, NC (US); Jeffrey J. Schedel, Apex, NC (US); Gerald Cooper Ushery, Jr., Raleigh, NC (US); Michael Richard Floyd, Wake Forest, NC (US); Weldon Curl, Jr., Garner, NC (US); Nanette Kirsch, Raleigh, NC (US); Timothy Ulm, Raleigh, NC (US); Daniel Gardiner, Wake Forest, NC (US)

(73) Assignee: Parata Systems, LLC, Durham, NC (US)

( * ) Notice: Subject to any disclaimer, the term of this patent is extended or adjusted under 35 U.S.C. 154(b) by 19 days.

(21) Appl. No.: 14/281,301

(22) Filed: May 19, 2014

(65) Prior Publication Data

US 2014/0252020 A1 Sep. 11, 2014

Related U.S. Application Data

(63) Continuation of application No. 13/181,873, filed on Jul. 13, 2011, now abandoned.

(60) Provisional application No. 61/364,038, filed on Jul. 14, 2010, provisional application No. 61/394,828, filed on Oct. 20, 2010, provisional application No. 61/424,161, filed on Dec. 17, 2010.

(51) Int. Cl.

| | |
|---|---|
| ***B65D 83/04*** | (2006.01) |
| ***G07F 11/58*** | (2006.01) |
| ***G07F 17/00*** | (2006.01) |

(52) U.S. Cl.

CPC ..... *B65D 83/0409* (2013.01); *G07F 11/58* (2013.01); *G07F 17/0092* (2013.01)

(58) Field of Classification Search

CPC G07F 17/0092; B65D 83/04; B65D 83/0445; B65D 83/0409; B65D 83/0481

USPC ..... 221/2, 7; 700/214, 215, 216, 218

See application file for complete search history.

(56) References Cited

U.S. PATENT DOCUMENTS

| | | | |
|---|---|---|---|
| 3,917,045 | A | 11/1975 | Williams et al. |
| 4,326,620 | A | 4/1982 | Felix et al. |

(Continued)

FOREIGN PATENT DOCUMENTS

| | | |
|---|---|---|
| CA | 2533754 | 6/2004 |
| WO | WO 96/32864 | 10/1996 |

*Primary Examiner* — Patrick Mackey

(74) *Attorney, Agent, or Firm* — Myers Bigel & Sibley, P.A.

(57) ABSTRACT

A system for storing and dispensing discrete doses of pharmaceuticals includes: a housing with an internal cavity having a front wall with first and second windows; multiple storage locations positioned within the housing; and a carrier assembly positioned and movable within the housing. The carrier assembly is configured to receive a pharmaceutical dose package loaded into either the first or second window and convey the pharmaceutical dose package to one of the storage locations for storage therein, and is further configured to retrieve a pharmaceutical dose package from one of the storage locations and return the pharmaceutical dose package to the first or second window for dispensing therefrom.

18 Claims, 26 Drawing Sheets

(56) References Cited

U.S. PATENT DOCUMENTS 4,519,522 A 5/1985 McElwee
4,546,901 A 10/1985 Buttarazzi
4,655,026 A 4/1987 Wigoda
4,717,042 A 1/1988 McLaughlin
4,785,969 A 11/1988 McLaughlin
4,821,917 A 4/1989 Brown
4,847,764 A 7/1989 Halvorson
4,953,745 A 9/1990 Rowlett, Jr.
4,967,928 A 11/1990 Carter
5,014,875 A 5/1991 McLaughlin et al.
5,292,029 A 3/1994 Pearson
5,346,297 A 9/1994 Colson, Jr. et al.
5,377,864 A 1/1995 Blechl et al.
5,404,384 A 4/1995 Colburn et al.
5,408,443 A 4/1995 Weinberger
5,431,299 A * 7/1995 Brewer et al. ..... 221/2
5,441,165 A 8/1995 Kemp et al.
5,460,294 A 10/1995 Williams
5,468,110 A 11/1995 McDonald et al.
5,490,610 A 2/1996 Pearson
5,502,944 A 4/1996 Kraft et al.
5,520,450 A 5/1996 Colson, Jr. et al.
5,661,978 A 9/1997 Holmes et al.
5,713,485 A 2/1998 Liff et al.
5,737,539 A 4/1998 Edelson et al.
5,745,366 A 4/1998 Higham et al.
5,755,357 A 5/1998 Orkin et al.
5,758,095 A 5/1998 Albaum et al.
5,761,877 A 6/1998 Quandt
5,790,409 A 8/1998 Fedor et al.
5,797,515 A 8/1998 Liff et al.
5,805,456 A 9/1998 Higham et al.
5,842,976 A 12/1998 Williamson
5,845,255 A 12/1998 Mayaud
5,848,593 A 12/1998 McGrady et al.
5,880,443 A 3/1999 McDonald et al.
5,883,806 A 3/1999 Meador et al.
5,905,653 A 5/1999 Higham et al.
5,912,818 A 6/1999 McGrady et al.
5,927,540 A 7/1999 Godlewski
5,940,306 A 8/1999 Gardner et al.
5,957,372 A 9/1999 Dean et al.
5,961,036 A 10/1999 Michael et al.
5,967,730 A 10/1999 Peroni
5,971,593 A 10/1999 McGrady
5,993,046 A 11/1999 McGrady et al.
6,003,006 A 12/1999 Colella
6,011,999 A 1/2000 Holmes
6,019,249 A 2/2000 Michael et al.
6,021,392 A 2/2000 Lester et al.
6,039,467 A 3/2000 Holmes
6,065,819 A 5/2000 Holmes et al.
6,068,156 A 5/2000 Liff et al.
6,108,588 A 8/2000 McGrady
6,109,774 A 8/2000 Holmes et al.
6,112,502 A 9/2000 Frederick et al.
6,116,461 A 9/2000 Broadfield et al.
6,151,536 A 11/2000 Arnold et al.
6,152,364 A 11/2000 Schoonen et al.
6,170,230 B1 1/2001 Chudy et al.
6,170,929 B1 1/2001 Wilson et al.
6,189,727 B1 2/2001 Shoenfeld
6,217,273 B1 4/2001 Peroni et al.
6,230,927 B1 5/2001 Schoonen et al.
6,272,394 B1 8/2001 Lipps
6,289,656 B1 9/2001 Wangu et al.
6,338,007 B1 1/2002 Broadfield et al.
6,339,732 B1 1/2002 Phoon et al.
6,361,263 B1 3/2002 Dewey et al.
6,370,841 B1 4/2002 Chudy et al.
6,385,505 B1 5/2002 Lipps
6,412,654 B1 7/2002 Cleeve
6,416,270 B1 7/2002 Steury et al.
6,470,234 B1 10/2002 McGrady
6,529,801 B1 3/2003 Rosenblum
6,532,399 B2 3/2003 Mase
6,564,121 B1 5/2003 Wallace et al.
6,625,952 B1 9/2003 Chudy et al.
6,640,159 B2 10/2003 Holmes et al.
6,650,964 B2 11/2003 Spano, Jr. et al.
6,658,322 B1 12/2003 Frederick et al.
6,671,563 B1 12/2003 Engelson et al.
6,671,579 B2 12/2003 Spano, Jr. et al.
6,707,381 B1 3/2004 Maloney
6,760,643 B2 7/2004 Lipps
6,785,589 B2 8/2004 Eggenberger et al.
6,788,997 B1 9/2004 Frederick
6,814,256 B2 11/2004 Clark
6,847,861 B2 1/2005 Lunak et al.
6,892,941 B2 5/2005 Rosenblum
6,895,304 B2 5/2005 Spano, Jr. et al.
6,975,922 B2 12/2005 Duncan et al.
7,010,389 B2 3/2006 Lunak et al.
7,048,142 B1 5/2006 Michael et al.
7,052,097 B2 5/2006 Meeks, Jr. et al.
7,072,855 B1 7/2006 Godlewski et al.
7,100,792 B2 9/2006 Hunter et al.
7,123,989 B2 * 10/2006 Pinney et al. ..... 700/237
7,175,081 B2 2/2007 Andreasson et al.
7,218,231 B2 5/2007 Higham
7,234,609 B2 6/2007 DeLazzer et al.
7,258,249 B1 8/2007 Frederick et al.
7,262,698 B1 8/2007 Frederick et al.
7,263,410 B1 8/2007 Frederick et al.
7,286,900 B1 10/2007 Frederick et al.
7,348,884 B2 3/2008 Higham
7,349,858 B1 3/2008 McGrady et al.
7,366,586 B2 4/2008 Kaplan et al.
7,384,410 B2 6/2008 Eggers et al.
7,427,002 B2 9/2008 Liff et al.
7,444,296 B1 10/2008 Barber et al.
7,447,605 B2 11/2008 Kuehnrich
7,463,947 B1 12/2008 Frederick et al.
7,483,756 B2 1/2009 Engleson et al.
7,483,766 B1 1/2009 Frankel
7,499,768 B2 3/2009 Hoersten et al.
7,584,869 B2 9/2009 DeLazzer et al.
7,596,427 B1 9/2009 Frederick et al.
7,620,157 B2 11/2009 Holmes et al.
7,630,791 B2 12/2009 Nguyen et al.
7,673,771 B2 3/2010 Bedore et al.
7,673,772 B2 3/2010 Bedore et al.
7,676,299 B2 3/2010 Clarke et al.
7,685,026 B1 3/2010 McGrady et al.
7,689,316 B1 3/2010 Frederick et al.
7,698,019 B2 4/2010 Moncrief et al.
7,719,420 B2 5/2010 Christie et al.
7,728,711 B2 6/2010 Shoenfeld
7,747,346 B2 6/2010 Lowe et al.
7,748,628 B2 7/2010 Greyshock
7,766,242 B2 8/2010 Lunak et al.
7,771,385 B2 8/2010 Eggers et al.
7,771,386 B2 8/2010 Eggers et al.
7,774,097 B2 8/2010 Rosenblum
7,774,233 B2 8/2010 Barber et al.
7,787,986 B2 8/2010 Pinney et al.
7,788,369 B2 8/2010 McAllen et al.
7,797,077 B2 9/2010 Hale
7,813,939 B2 10/2010 Clements et al.
7,853,354 B2 12/2010 Kuehnrich et al.
7,860,605 B2 * 12/2010 Frankel ..... 700/236
7,865,263 B2 1/2011 Spano, Jr. et al.
2001/0044731 A1 11/2001 Coffman et al.
2002/0032582 A1 3/2002 Feeney, Jr. et al.
2002/0095680 A1 7/2002 Davidson
2005/0004700 A1 1/2005 DiMaggio
2005/0144037 A1 6/2005 Geiger
2005/0184151 A1 8/2005 DiMaggio et al.
2005/0261940 A1 11/2005 Gay et al.
2005/0263429 A1 12/2005 Engelke
2006/0036507 A1 2/2006 Pujar et al.
2006/0053036 A1 3/2006 Coffman et al.
2006/0125356 A1 6/2006 Meeks, Jr. et al.
2006/0220507 A1 10/2006 Steele et al.

(56) References Cited

U.S. PATENT DOCUMENTS

2007/0023512 A1 2/2007 Miller et al.
2007/0135965 A1 6/2007 Nguyen et al.
2007/0150382 A1 6/2007 Danilewitz
2007/0162183 A1 7/2007 Pinney et al.
2007/0162184 A1* 7/2007 Pinney et al. ..... 700/241
2007/0169132 A1 7/2007 Blust et al.
2007/0250210 A1 10/2007 Moncrief et al.
2007/0262147 A1 11/2007 Braun et al.
2007/0265729 A1 11/2007 Braun et al.
2007/0265730 A1 11/2007 Greyshock
2008/0059228 A1 3/2008 Bossi et al.
2008/0086235 A1 4/2008 Frankel
2008/0103626 A1 5/2008 Frankel
2008/0264962 A1 10/2008 Schifman et al.
2008/0264967 A1* 10/2008 Schifman et al. ..... 221/133
2008/0272138 A1 11/2008 Ross et al.
2008/0300794 A1 12/2008 Greyshock
2008/0306740 A1 12/2008 Schuck et al.
2008/0319575 A1 12/2008 Vahlberg et al.
2008/0319576 A1 12/2008 Vahlberg et al.
2008/0319577 A1 12/2008 Vahlberg et al.
2008/0319578 A1 12/2008 Vahlberg et al.
2008/0319579 A1 12/2008 Vahlberg et al.
2008/0319580 A1 12/2008 Vahlberg et al.
2008/0319581 A1 12/2008 Vahlberg et al.
2008/0319789 A1 12/2008 Vahlberg et al.
2008/0319790 A1 12/2008 Vahlberg et al.
2009/0012820 A1 1/2009 Bishop et al.
2009/0014458 A1 1/2009 Heffron
2009/0037020 A1 2/2009 Brown
2009/0089187 A1 4/2009 Hoersten et al.
2009/0108011 A1 4/2009 Heffron
2009/0114672 A1 5/2009 Schifman et al.
2009/0164376 A1 6/2009 Guthrie
2009/0166415 A1 7/2009 Braun et al.
2009/0169138 A1 7/2009 Bieganski
2009/0194987 A1 8/2009 Christie et al.
2010/0042437 A1 2/2010 Levy et al.
2010/0057871 A1 3/2010 Kaplan et al.
2010/0176699 A1 7/2010 Biba et al.
2010/0180547 A1 7/2010 Foucher et al.
2010/0228392 A1 9/2010 Braun
2010/0239169 A1 9/2010 Braun et al.
2010/0241446 A1 9/2010 Eckert et al.
2010/0300041 A1* 12/2010 Kim ..... 53/281
2011/0030034 A1 2/2011 Ross
2011/0054668 A1* 3/2011 Holmes et al. ..... 700/216
2011/0172815 A1* 7/2011 Kim ..... 700/235

* cited by examiner

AUTOMATED PHARMACY SYSTEM FOR DISPENSING UNIT DOSES OF PHARMACEUTICALS AND THE LIKE

RELATED APPLICATIONS

The present application claims priority from U.S. Provisional Patent Application Nos. 61/364,038, filed Jul. 14, 2010; 61/394,828, filed Oct. 20, 2010; and 61/424,161, filed Dec. 17, 2010, the disclosure of each of which is hereby incorporated herein in its entirety.

FIELD OF THE INVENTION

The present invention relates generally to dispensing machines, and more particularly to dispensing machines for pharmaceuticals.

BACKGROUND OF THE INVENTION

Long-term care medical facility settings include assisted living facilities, skilled nursing facilities, group homes, etc. Assisted living and skilled nursing facilities typically have medical staff that are responsible at all times for and oversee the administration of medication to the patients/residents of the facility, as prescribed by the physician or otherwise needed. Group homes may or-may not have live-in or around-the-clock staff that are responsible for all medication administration to the residents; such staff may be available only on a periodic basis (e.g., only during the day time, one or more times per week, etc.) in which case the residents may be responsible for their own medication the majority of the time. Such long-term care facilities are increasingly being asked to handle more and more of the medication storage responsibility that once rested almost totally with the community pharmacy. Long-term care pharmacy providers are typically not located within the actual patient facility; in fact, it is not uncommon for the pharmacy to be several hundred miles away. With new patient admissions occurring at unpredictable times throughout the day and existing patients' medical regimens changing without notice, it is imperative for those facilities without a physical pharmacy on site or access to one in a timely manner, to have non-patient specific medications on site for facility administration to the patients. Historically, facilities have stored medications in various types of non-mechanized containers and tracked drug product additions and removals with manual logs. Mechanized systems have primarily been limited to storage cabinets with a variety of drawers that house specific medications in predetermined locations. The drawer systems typically have secure access features which limit access to authorized users, typically facility staff that have the appropriate credentials, passcode, security pass, etc. to enable unlocking of a drawer to allow access to that user; however, once a user opens a drawer, there are only limited safeguards to prevent the wrong quantity or wrong drug from being removed, as this is a manual selection and removal process by the system user.

In view of the foregoing, it may be desirable to provide improved systems for dispensing medications for patients in long-term care facilities and other medical environments.

SUMMARY OF THE INVENTION

As a first aspect, embodiments of the present invention are directed to a system for storing and dispensing discrete doses of pharmaceuticals. The system comprises: a housing with an internal cavity having a front wall with first and second windows; multiple storage locations positioned within the housing; and a carrier assembly positioned and movable within the housing. The carrier assembly is configured to receive a pharmaceutical dose package loaded into either the first or second window and convey the pharmaceutical dose package to one of the storage locations for storage therein, and is further configured to retrieve a pharmaceutical dose package from one of the storage locations and return the pharmaceutical dose package to the first or second window for dispensing'therefrom.

As a second aspect, embodiments of the present invention are directed to a system for storing and dispensing discrete doses of pharmaceuticals, comprising: a housing with an internal cavity having a front wall with a window; multiple storage locations positioned within the housing; a carrier assembly positioned and movable within the housing; and a plurality of bins, each of the bins configured to reside in one of the storage locations. The carrier assembly is configured to receive a bin that contains a pharmaceutical dose package loaded into the window and convey the bin and pharmaceutical dose package to one of the storage locations for storage therein, and is further configured to retrieve a bin that contains a pharmaceutical dose package from one of the storage locations and convey the bin and pharmaceutical dose package to the window for dispensing therefrom.

As a third aspect, embodiments of the present invention are directed to a carrier assembly for a storage and dispensing apparatus, comprising: a base; a pair of jaws, the jaws having facing contact surfaces that are substantially parallel to each other; a first drive unit coupled to the jaws and the base configured to reciprocally drive the jaws toward and away from each other; and a second drive unit coupled to the jaws, the first drive unit and the second drive unit configured to convey the jaws in either direction substantially parallel to the contact surfaces.

As a fourth aspect, embodiments of the present invention are directed to a bin for receiving, storing and dispensing a pharmaceutical dose package, comprising a box having first and second opposed, generally parallel side walls spanned by a floor and a rear wall. The front end of the box is open, and the first side wall includes an open-ended slot.

As a fifth aspect, embodiments of the present invention are directed to a carousel assembly, comprising: first and second sprockets; an endless member having a radially inward surface that engages the first and second sprockets, the endless member defining a generally oblong path; and a plurality of support members attached to the radially inward surface of the endless member and extending generally perpendicular to a plane defined by the oblong path. The first sprocket has a plurality of perimeter pockets, the perimeter pockets being sized and configured to receive the support members as they travel along the oblong path.

DETAILED DESCRIPTION OF EMBODIMENTS OF THE INVENTION

Figure 1:
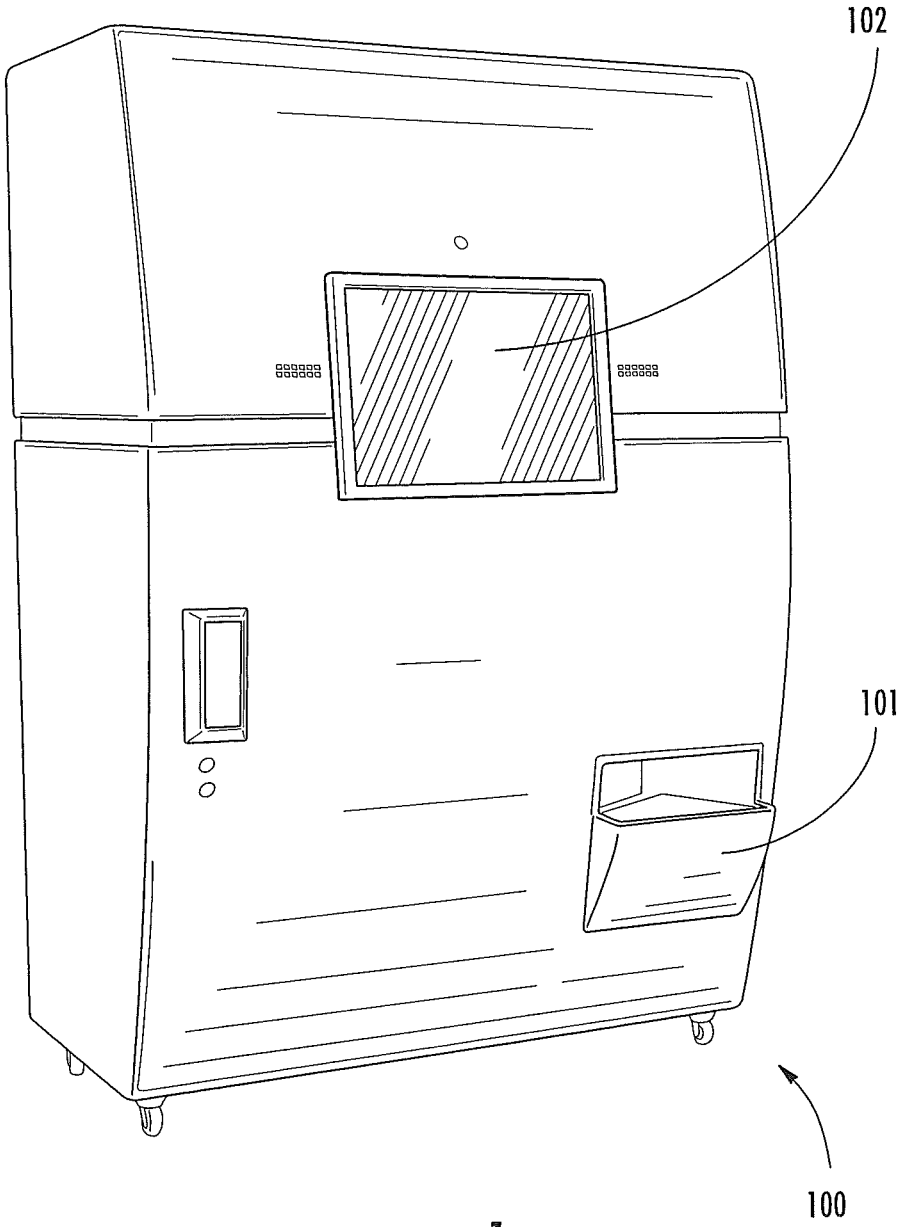
FIG. 1 is a perspective view of an automated pharmacy system according to embodiments of the present invention.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

The proposed system utilizes a unit dose storage system that allows any medication to be stored in any location of the unit. Unit doses may be prepared in any number of ways; exemplary methods are disclosed in, for example, U.S. Pat. Nos. 6,449,921; 6,585,132; and 7,428,805, the disclosures of which are hereby incorporated herein. An exemplary unit dose package 310 is shown in connection with an automated pharmacy system 300 in FIG. 8, although the package 310 may take different forms such as a blister pack, strip pack, box, bag, vial, IV solution bag, ampoule, etc. The proposed system utilizes bar code reading technology (i.e., a bar code scanner to read the bar code 311 on the package 310); however, future embodiments could include other identification technology, such as RFID, to provide confirmation of the identity of the product and/or to associate a specific product to a specific location within the unit after the product has been loaded into the device.

Although the product may be scanned to read the affixed code prior to placement in the specific location, in some embodiments the association of a product to a location only occurs after the product has been loaded into an unoccupied product storage location within the system. Even when the items are scanned prior to placement in a location, the system may still scan each location to ensure that the product was properly placed in the system. Either during loading of an individual product or immediately after a variety of products are loaded in bulk into the system, the system's bar code verification process validates which products are stored in which location by scanning each location. Each system storage location contains only one unique product, although the quantity of that product can vary. Each product packet may hold one or more pills of a given medication, and the system may include different packets having different numbers of pills of the same medication to facilitate different dosing options (e.g., there may be separate packets with one, two, three or four pills of 200 mg ibuprofen to facilitate administration of 200 mg, 400 mg, 600 mg, or 800 mg doses of the medication, depending on a doctor's orders).

Figure 2:
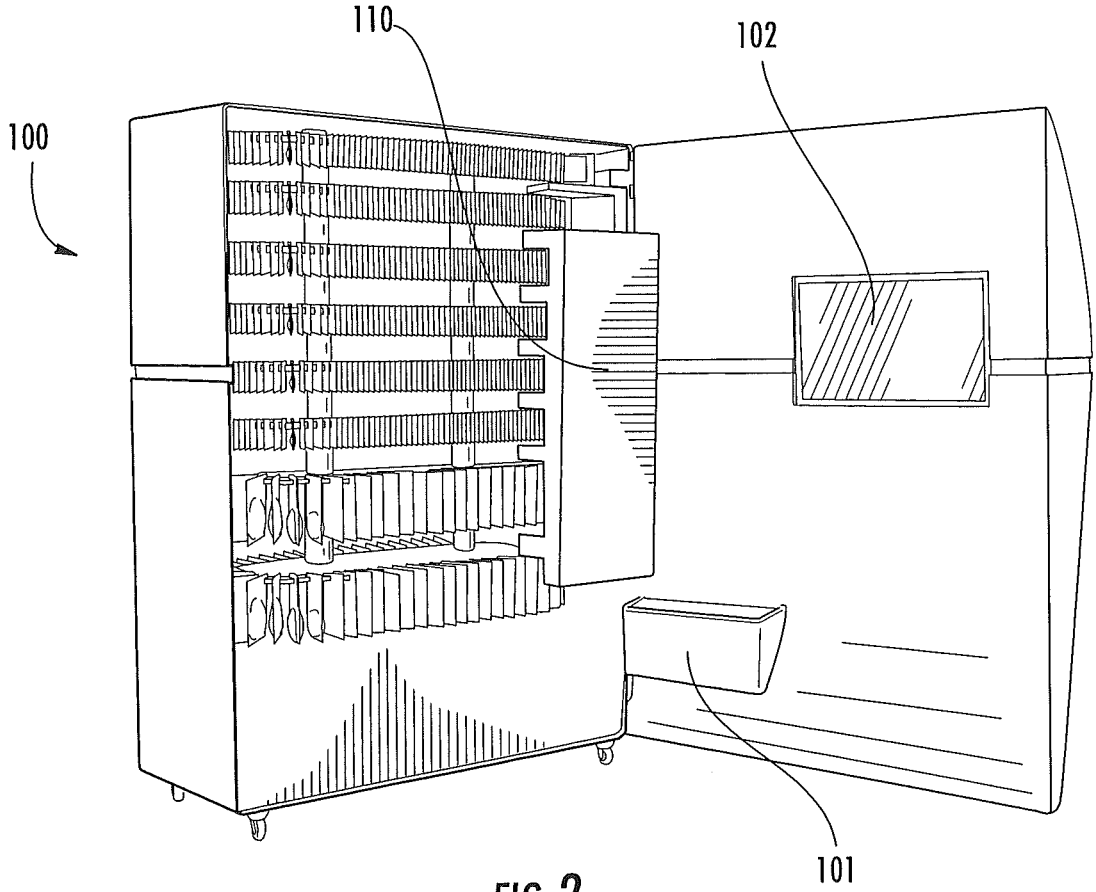
FIG. 2 is a perspective view of the system of FIG. 1 with the door shown in an open position for loading of prescriptions.
Figure 3:
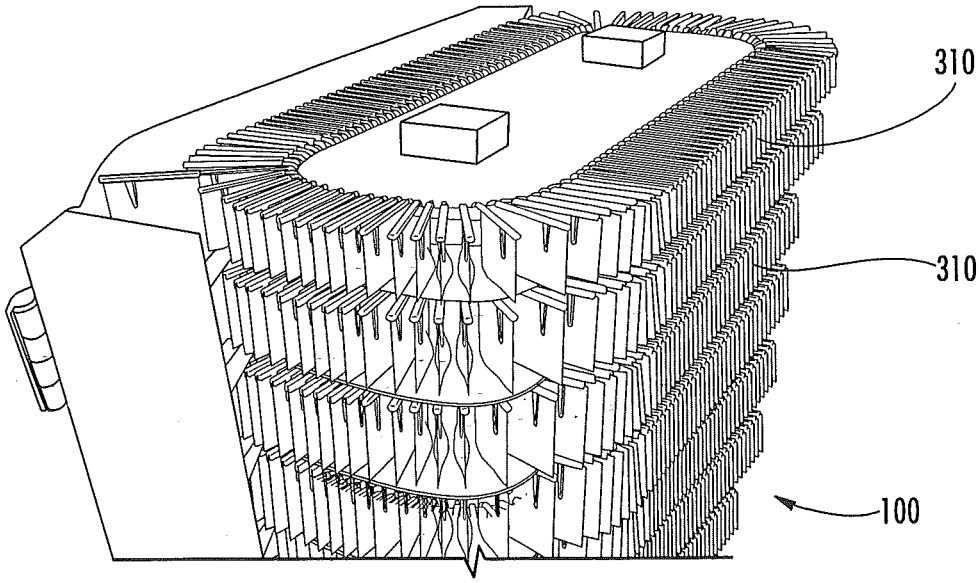
FIG. 3 is a top perspective view of carousels of the system of FIG. 1.

FIGS. 1-5 illustrate an automated pharmacy system 100 in which products are stored on a series of rotating horizontal carousels that utilize storage clips/slots/bins to securely hold individual products. The overall system 100 is illustrated in FIG. 1 with its front door closed and in FIG. 2 with the front door open. Each storage location in the system 100 has a unique location ID in the system. Once a product is loaded, or when the product is scanned while loading the product into the system 100, and/or upon a scanning confirmation of product placement after loading, the system creates an association between the location and the product. Loaded products 310 are shown in FIG. 3. In some embodiments, the system is loaded with products by opening the door of the unit, as shown in FIG. 2, and products are placed in available and/or designated locations.

Figure 8:
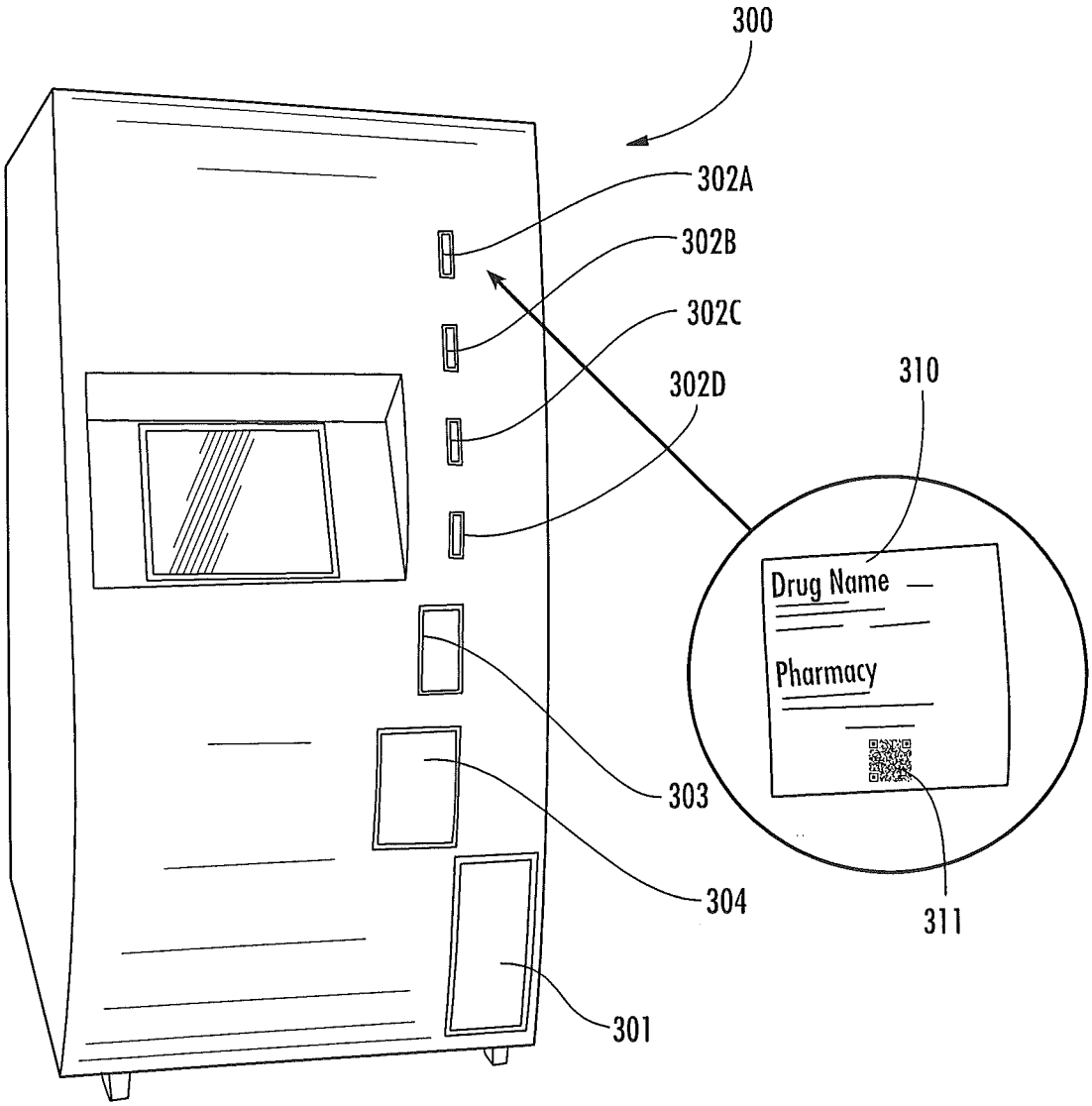
FIG. 8 is a front perspective view of an automated pharmacy system according to further embodiments of the present invention.

Alternatively, as shown in FIG. 8, the system 300 may utilize slots 302A-D, 303 and 304 to allow loading of product into the unit without opening the door to expose the entire contents of the system. In the system 300, the slots 302A-D, 303 and 304 may be covered by a single door or individual doors. Upon a request to load a package of a particular size into the system, a controller sends a command to open the appropriately sized slot corresponding to the physical storage level in which a storage location is available. The product to be added to the inventory is then inserted into the accessible slot 302A-D, 303 or 304. For example, in a system where a door or doors cover the slots 302A-D, 303 or 304, upon a request to add a small package, such as an individual medication package 310, to the inventory of the system, the controller sends a command to open the door associated with slot 302A when an available storage location is located on the uppermost level of the unit. The package is inserted into the slot 302A by the user, and rollers or another transport mechanism convey the package to the interior of the unit. The rollers may be made of flexible material so as to not damage the package or its contents. Scanners may be co-located with the slots 302A-D, 303, 304 so that the barcode or other identifying indicia on the package 310 is scanned as the package is entering through the slot. In some embodiments the scanners may be associated with the inside edge of the slot so that the bar code 311 is read after the package is retained inside the unit to protect the system from deliberate or unintentional entry of a package different from the scanned package. The package 310 may be loaded directly into the storage bin or holding clip (see FIG. 4 and accompanying discussion, infra) as it enters through the slot or it may be captured by a robotic arm that then transports the package 310 from the slot to the available storage location. If available storage locations for a small package are instead located on the second level of the unit, the door to slot 302B opens and the same process is followed. If the package to be loaded is of a larger size, appropriate for storage locations associated with slot 303 or 304, then the door associated with the appropriate slot is opened and the product is loaded as discussed. In other embodiments, one or more loading slots may be provided in other locations not associated with the separate storage levels, for example at the bottom on the unit, where all product 310 to be loaded into the unit is introduced via rollers, as described above, and retrieved by a robotic arm for placement in a storage location anywhere within the unit. A single slot or door may be provided for loading of products 310 of all sizes, or slots/doors of various sizes may be provided in the same general vicinity to accommodate loading of products of different size classes.

In some embodiments of the invention, the system may accept totes or other containers capable of large capacity storage; such totes would contain some or all of the inventory to be loaded into the system. Once the tote is deposited inside the unit (via a door or other access method), a robotic arm (i.e., actuator and end effector) inside the unit may remove individual packages from the tote or loading area and place each package in an available storage location within the unit. The robotic arm may include a bar code scanner to automatically scan the indicia on the package prior to placing the package in a storage location. Alternatively, the robotic arm may first move the package to a scanner for scanning prior to placing the package in the storage location.

Figure 4:
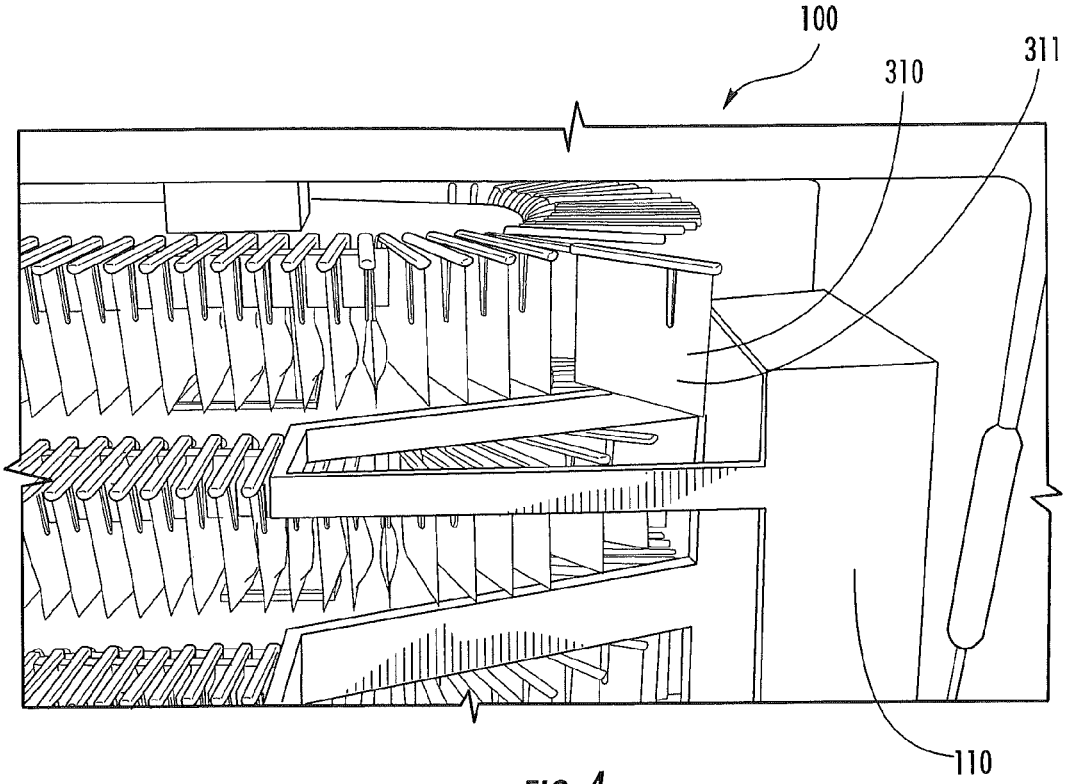
FIG. 4 is an enlarged front perspective view of a prescription being dispensed into the dispensing chute of the system of FIG. 1.
Figure 6:
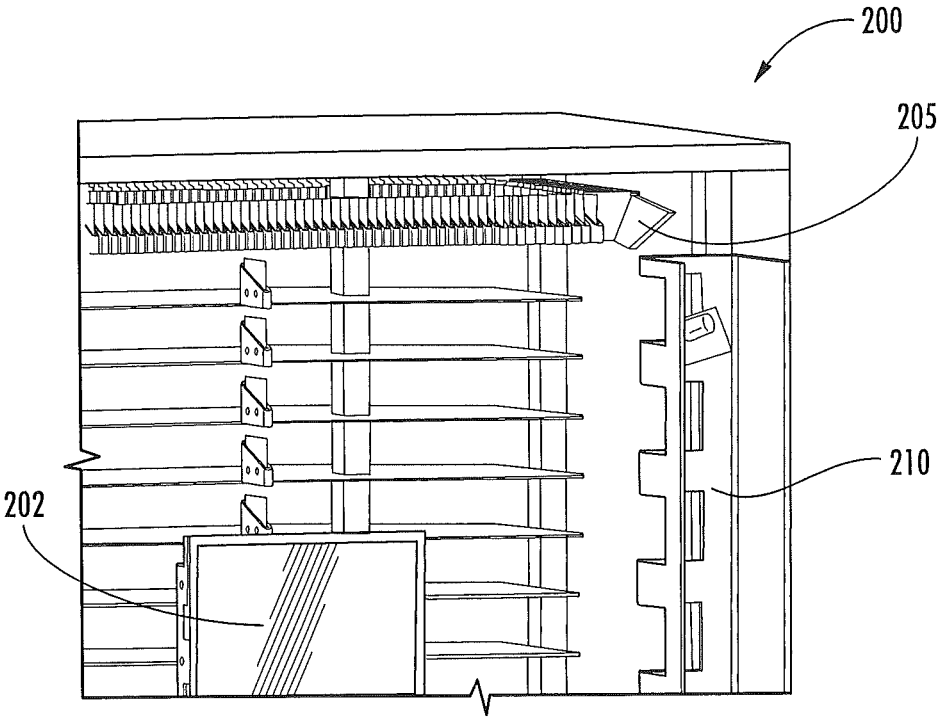
FIG. 6 is an enlarged perspective view of an automated pharmacy system according to alternative embodiments of the present invention, with the door removed for clarity, showing a prescription dropping down the dispensing chute.
Figure 7:
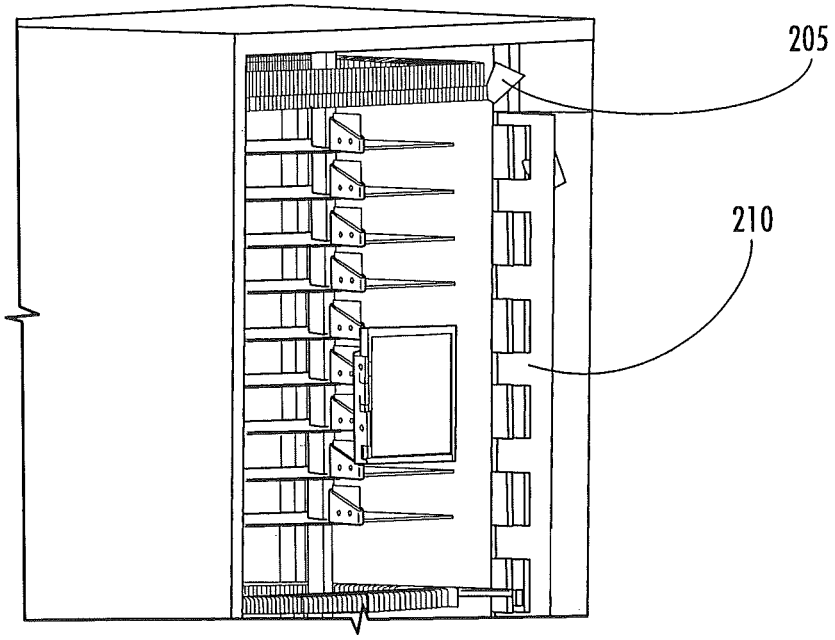
FIG. 7 is perspective view of the system of FIG. 6.

Upon receipt of a dispense request, the system determines the location of the user selected products and dispenses them by rotating the carousel/bins containing the products to a delivery chute (see FIG. 4). In some embodiments of the invention, such as that exemplified in FIG. 4, each product 310 is held by a clip in its respective location. Upon a dispense request from the controller, the requested product 310 is moved (i.e., by a telescoping action of a rod attached to the clip) to a position above a delivery chute 110 and the product is released from the clip into the delivery chute 110 (i.e., prongs of the clip are separated to release the package). In other embodiments, such as the system 200 shown in FIGS. 6 and 7, each location may include an appropriately sized bin 205 that holds the product 310 in its location. In such embodiments, upon a dispense request from the controller, the bin 205 is tilted so as to empty its contents into the delivery chute 210.

Figure 5:
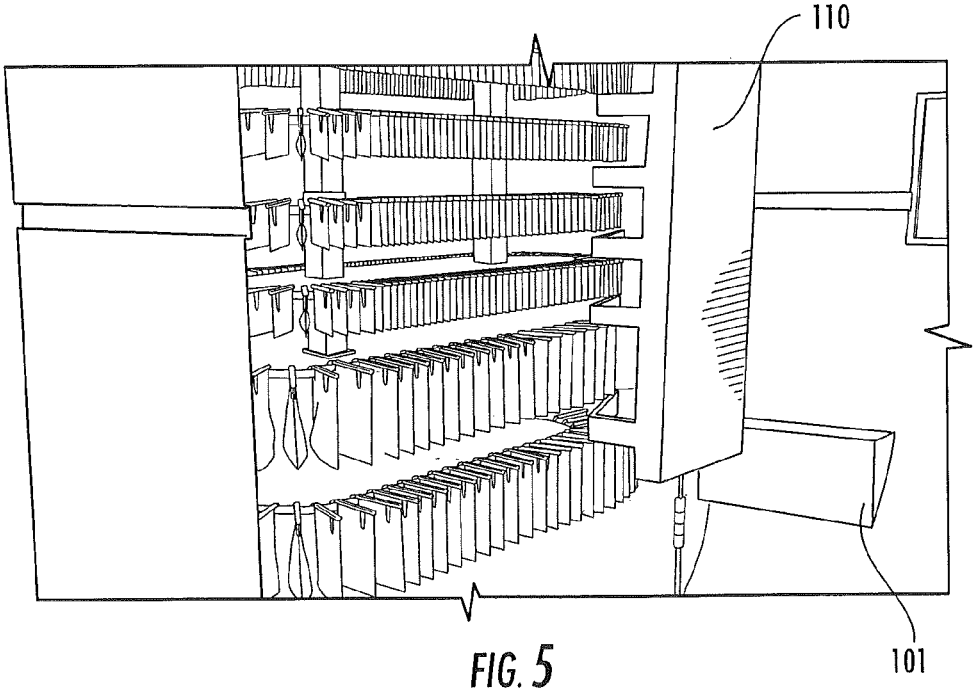
FIG. 5 is a side perspective view of the carousels and dispensing chute of the system of FIG. 1 with the door shown in an open position.

Once the products are released from the carousel/bin, they descend down the delivery chute to the user pick-up slot (the pick-up slot 101 can be seen in FIG. 5 mounted to the inside of the access door and on the outside of the unit 100 in FIG. 1 and the pick-up slot 301 can be seen on the outside of the unit 300 in FIG. 8). The various levels of the system can function independently such that multiple products can be dropped simultaneously from the different carousels down the delivery chute to the user pick-up slot 101, 301 or they may be dropped sequentially to allow the user to retrieve them from the pick-up slot 101, 301 simultaneously. The user has access to the products once they have landed in the user pick-up slot. The access door to the pick-up slot may be locked to prevent unauthorized access to medications that have been dispensed (see discussion below regarding security and user authorization). In some embodiments, the system includes refrigeration for one or more levels of storage locations. Such refrigerated units may be used to store medications such as, for example, insulin, certain antibiotics, or other medications that require storage at temperatures lower than ambient temperature.

Users access the system 100 via a touch screen 102 (shown in FIG. 1), which interfaces with software and a controller which validates a user's credentials against a database to ensure only those individuals who have been authorized to utilize the system can access products contained within the unit or to run any form or reporting on the system. In some embodiments of the invention, all users must have the proper credentials to access the system and, once validated, may dispense any of the medications from the system. In other embodiments, once validated as an authorized user of the system, some users may be permitted to dispense only a portion of the types of medications in the system due to security considerations (i.e., some users may be allowed to access all types of medications except narcotics). In some embodiments, users may be required to confirm their identity (i.e., enter an authorization code, scan an identification badge, or satisfy an RFID or biometric-based security check) and have their level of authorization confirmed by the system prior to the controller signaling release of the lock on the access door to the pick-up slot in order to allow access to the dispensed medication). All user access and activity can be stored on the system via data base entries, biometric logs and digital photography.

User interaction with the touch screen 102 also may include selection of the medication to be dispensed, selection of the patient for whom the medication is being dispensed, requests for various types of reports (see below), restocking requests, inventory analysis, etc.

In some embodiments of the invention, various types of records are maintained by the system and reports of such records may be created by the system. Records may include information regarding which users accessed the system and the date and time of the access, which medications were dispensed, which medications were dispensed by each user, the patient for whom each medication was dispensed, etc. Such reports may be created upon request or the system may be programmed to create certain reports automatically (e.g., at the end of a shift, when a patient is discharged or moved from the facility, etc.).

In some embodiments, the system may include a camera (not shown) on the outside of the unit to capture the image of a user when accessing the system. Each picture taken by the camera may be stored in the system and matched against a particular activity such as replenishment of the unit on a specific day at a specific time and with respect to particular items that were stocked in the unit at that time, or a dispensing event of a particular medication or other item for a specific patient. The images may be included in the reports created by the system, as discussed above.

The system may be connected to the supplying pharmacy's pharmacy management system (e.g., its computer system) and may automatically communicate with information stored in the pharmacy management system. Such communications may include information regarding which medications have been dispensed from the system and, therefore, need to be restocked, confirmation that a medication that a user has requested for a particular patient has been approved for administration to that patient, etc. Other embodiments may include a two-way video and/or audio link with the pharmacy to facilitate approval for the removal of certain drugs (narcotics for example) from the unit regardless of patient drug regimens. Through such a link, a system user may request a drug that has not yet been approved for administration to a particular patient and provide the information necessary for review by the pharmacist (change in doctor's order, reason for request for administration to that patient, etc.). The pharmacist may then perform appropriate reviews (drug interactions, insurance adjudication, etc.) and either approve or disapprove the dispensing of the drug from the system for the specified patient.

The system may be connected to a scanner that can be used in the administration of the medication to the patient. Such a scanner may be a wireless portable scanner or may be located in the patient rooms ("bedside scanners"). A bedside scanner may be configured as assigned to a particular patient or either the portable or the bedside scanner may be used to scan a code on the patient's wristband or other form of identification to identify the patient. When the dispensed medication is administered to the patient, the portable or bedside scanner may additionally be used to scan the indicia on the medication package to confirm that the correct medication is being given to the correct patient. Such codes on the package or associated with the patient may be barcode, RFID or other appropriate technology. Via software and a wireless or Ethernet-based connection, the scanner may then communicate with the system to record the administration of the medication to the patient. Additionally, the scanner may be able to be docked on or near the unit to recharge the scanner and/or download information.

Various security features may be included with the system. The unit may be bolted to the floor or wall and may include security doors that are able to withstand attempts at forced entry and are self locking upon manual closure. The system may include an alarm system that is triggered by any movement of the unit, forced entry or other manipulation, power failure after manipulation, etc. In some embodiments, the system may include a sensor to detect if the door is opened. The system may be configured to sound an alarm when the door is opened without proper authorization or if the door remains open for an extended time period. Additionally, the unit may include an internal camera to capture images when the system is opened. The camera may be adapted to run off battery power so that it is able to function even when power is not supplied to the unit as a whole. The alarm system may be tied into facility security and may have the ability to contact local authorities. The alarm system may operate independently of the facility power source and may be able to maintain or bypass internet connectivity if that can also be compromised. A camera on the unit may be activated for image capture if the alarm is triggered.

In some embodiments, the system may include temperature, humidity, and/or other environmental sensors to monitor environmental conditions within the cabinet to ensure proper storage conditions of the items. The sensor may interface to an external monitor or other display so that the temperature/humidity conditions can be evaluated from outside the unit. The environmental sensor(s) may work in conjunction with an alarm system to notify users when environmental conditions within the cabinet are not within acceptable ranges.

The unit may be enabled for user authorization via biometric scanning (i.e., fingerprint, palm print, retinal scan, voice recognition, facial recognition, etc.). Unit security features may also or alternatively include a requirement for scanning of a user badge or entry of a code. User authorization may be performed prior to dispensing or restocking of the unit and authentication information recorded and stored by the unit.

Figure 9:
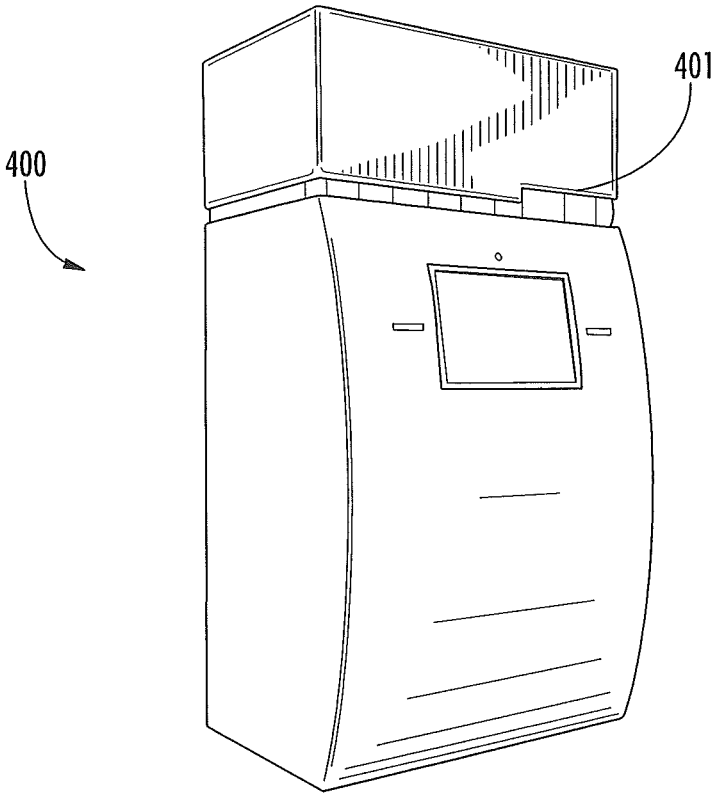
FIG. 9 is a front perspective view of an automated pharmacy system according to still further embodiments of the present invention.
Figure 10:
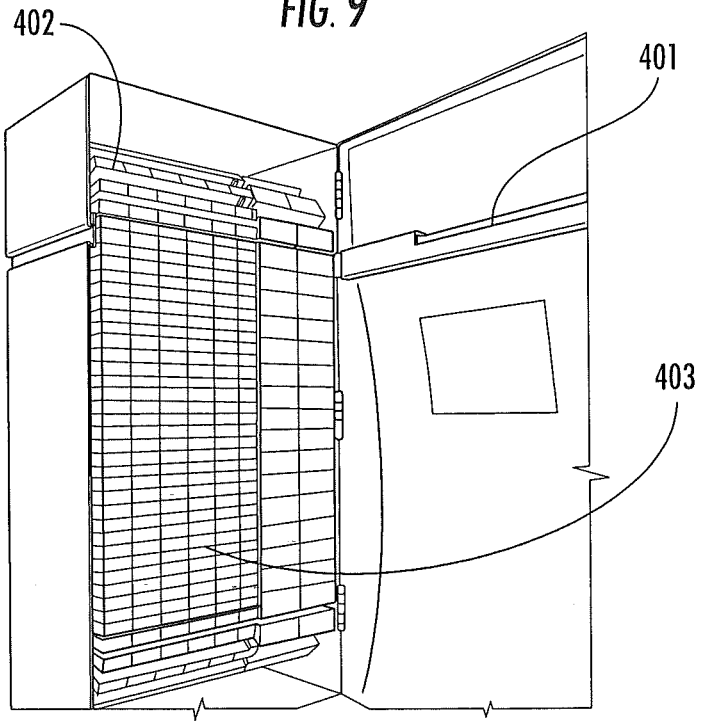
FIG. 10 is a front perspective view of the system of FIG. 10, shown with the door in an open position.

Another embodiment of the present invention is illustrated in FIGS. 9 and 10. The system 400 shown therein utilizes vertically-oriented carousels 402 that contain products within compartments 403 that rotate with the carousel. A horizontal row of access doors 401 is located in the front of the cabinet door. Each access door is aligned with one of the carousels 402 and opens when the compartment 403 containing the desired product is rotated into position just rearward of the access door 401. A similar arrangement is shown in U.S. Pat. No. 7,228,200 to Baker, the disclosure of which is hereby incorporated herein in its entirety.

The embodiments described herein may also be applicable in a traditional hospital setting where the administration of medication to patients is overseen by hospital staff and may need to occur on an as-needed basis. By providing access to such a system on hospital floors or in hospital emergency rooms (as well as urgent care centers), access to medications can be provided even when access directly to the pharmacy itself is not feasible.

Figure 11:
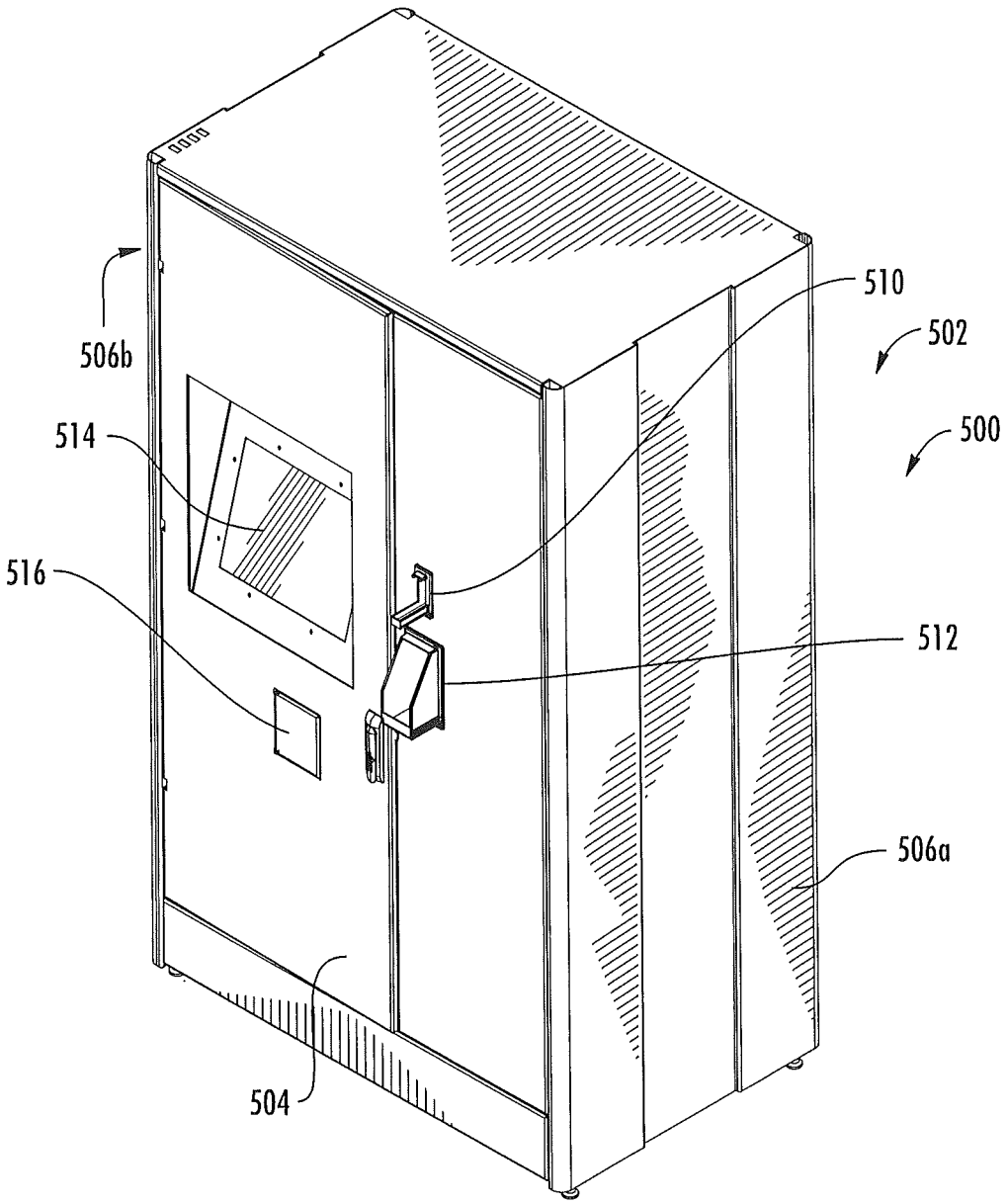
FIG. 11 is a front perspective view of an automated pharmacy system according to additional embodiments of the present invention.
Figure 11A:
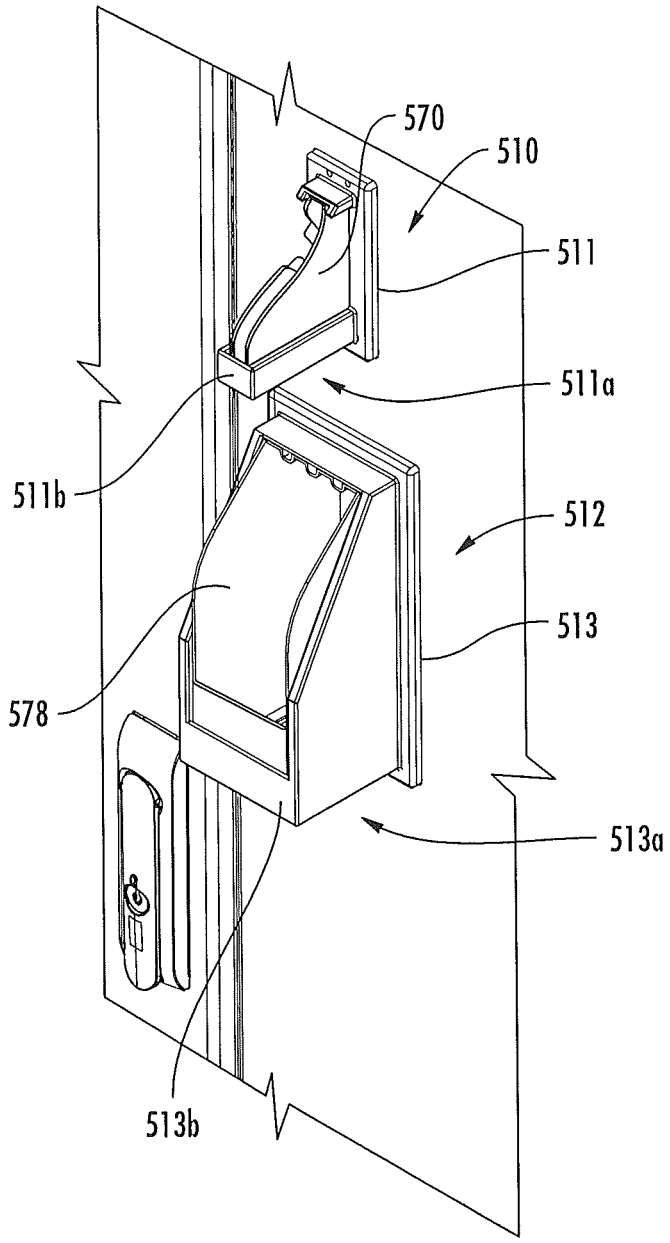
FIG. 11A is an enlarged perspective view of the system of FIG. 11 showing the small and large dispensing windows.

Another system according to embodiments of the present invention is shown in FIGS. 11-23L and designated broadly at 500. As can be seen in FIGS. 11 and 11A, the system 500 includes a housing 502 having a front wall 504 and side walls 506*a*, 506*b* that define an internal cavity. A small dispensing window 510 is present in the front wall 504, as is a large dispensing window 512 below the small dispensing window 510. A display screen 514 is located on the front wall 504 to receive input from a user and to display information about the system 500; the display screen 514 is connected with a controller (not visible in FIG. 11) that controls operation of the system 500. A bar code scanner 516 is also mounted to the front wall 504.

Referring to FIG. 11A, the small dispensing window 510 includes a rectangular frame 511 having an attached horizontal stage 511*a* that projects forwardly away from the front wall 504. As can be seen in FIG. 11A, the stage 511*a* has an upraised rim 511*b* about its periphery to capture and retain a small bin 570 (discussed in greater detail below) on the stage 511*a*. Similarly, the large dispensing window 512 has a frame 513 and a stage 513*a* that projects forwardly away from the front wall 504; a rim 513*b* is located on the periphery of the stage 513*a* to capture and retain a large bin 578 (also discussed in greater detail below). Either or both of the small and large dispensing windows 510, 512 may have a door (e.g., a sliding plate—this is not shown herein) that covers the window 510, 512 when the system 500 is inactive.

Figure 12A:
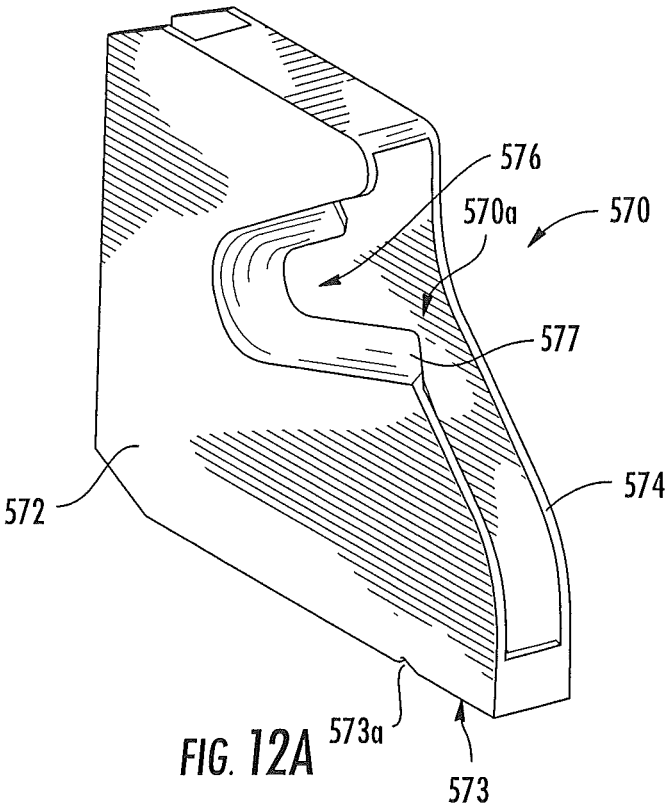
FIG. 12A is a perspective view of a small bin used in the system of FIG. 11.

Turning now to FIG. 12A, a small bin 570 is a truncated box with two side walls 572, 574 and a floor 573. As can be seen in FIG. 12A, the side wall 572 includes a slot 576 that extends from the front edge of the side wall 572 toward the rear of the small bin 570. The slot 576 is lined with a curved flange 577 that extends into the small bin 570 to form a narrow gap 570*a*, and flares open slightly at its open end. The floor 573 of the small bin 570 includes a recess 573*a*.

Figure 12B:
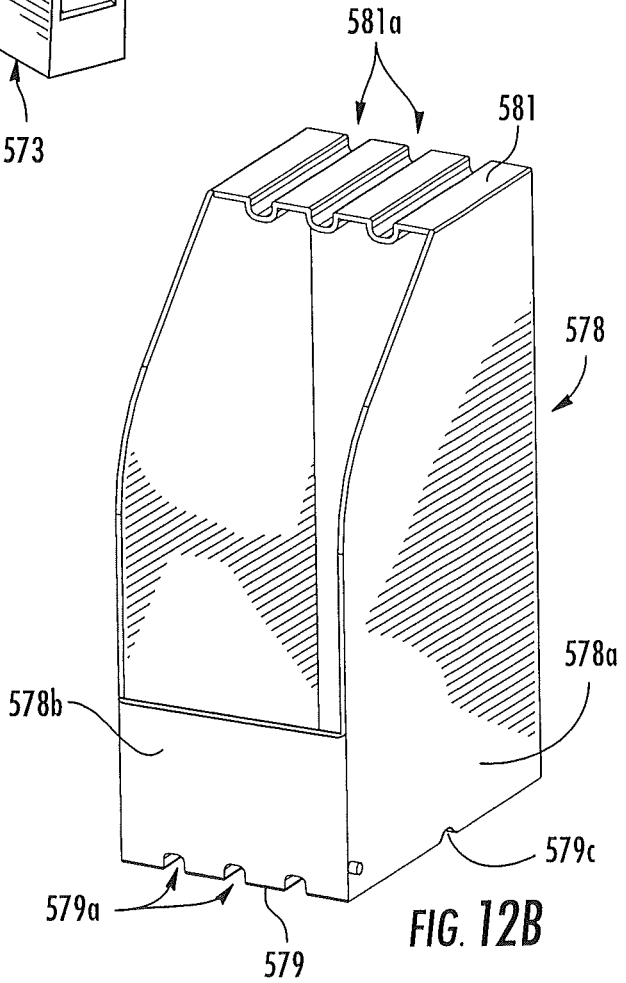
FIG. 12B is a perspective view of a large- bin used in the, system of FIG. 11.
Figure 12C:
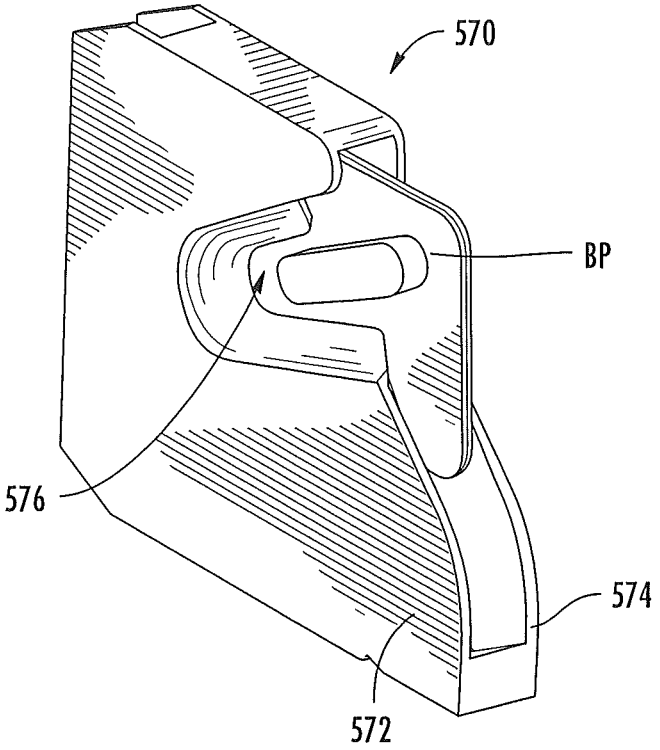
FIG. 12C is a perspective view of the small bin of FIG. 12A holding a "blister-pack" pharmaceutical package.
Figure 12D:
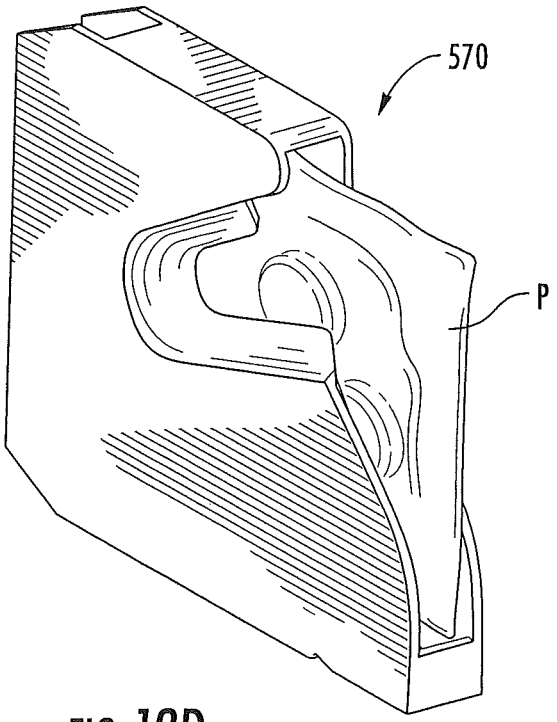
FIG. 12D is a perspective view of the small bin of FIG. 12A holding a single dose pharmaceutical package.

As can be seen in FIG. 12C, the small bin 570 is sized to hold a single dose "blister pack" BP of a pharmaceutical (with the upstanding "blister" residing in the slot 576). The small bin 570 is also sized to hold a conventional single dose of a pharmaceutical P (see FIG. 12D). The gap 570*a* is sufficiently narrow that it tends to retain the packaging in the bin 570 so that the packaging does not fall out of the bin 570; the oblique angle of the slot 576 relative to the bin floor can also help to retain the packaging. Also, the narrow space between the side walls 572, 574 urges the package to remain generally vertical, which enables a bar code positioned on the side of the packaging to be in a predictable location and therefore to be readable to a bar code scanner 550*a*, 550*b* located on a carrier assembly 530 (described below), particularly if the bin 570 is formed of a transparent material.

Referring to FIG. 12B, the large bin 578 includes is a box with side walls 578*a*, 578*b* that are spanned by a floor 579 and a ceiling 581. The floor 579 includes three slots 579*a*; the ceiling includes three slots 581*a*. The side walls 578*a*, 578*b* are separated by a width that is substantially equal to the width of four small bins 570. A "half" front wall helps to retain pharmaceutical packages within the large bin 578.

Figure 13:
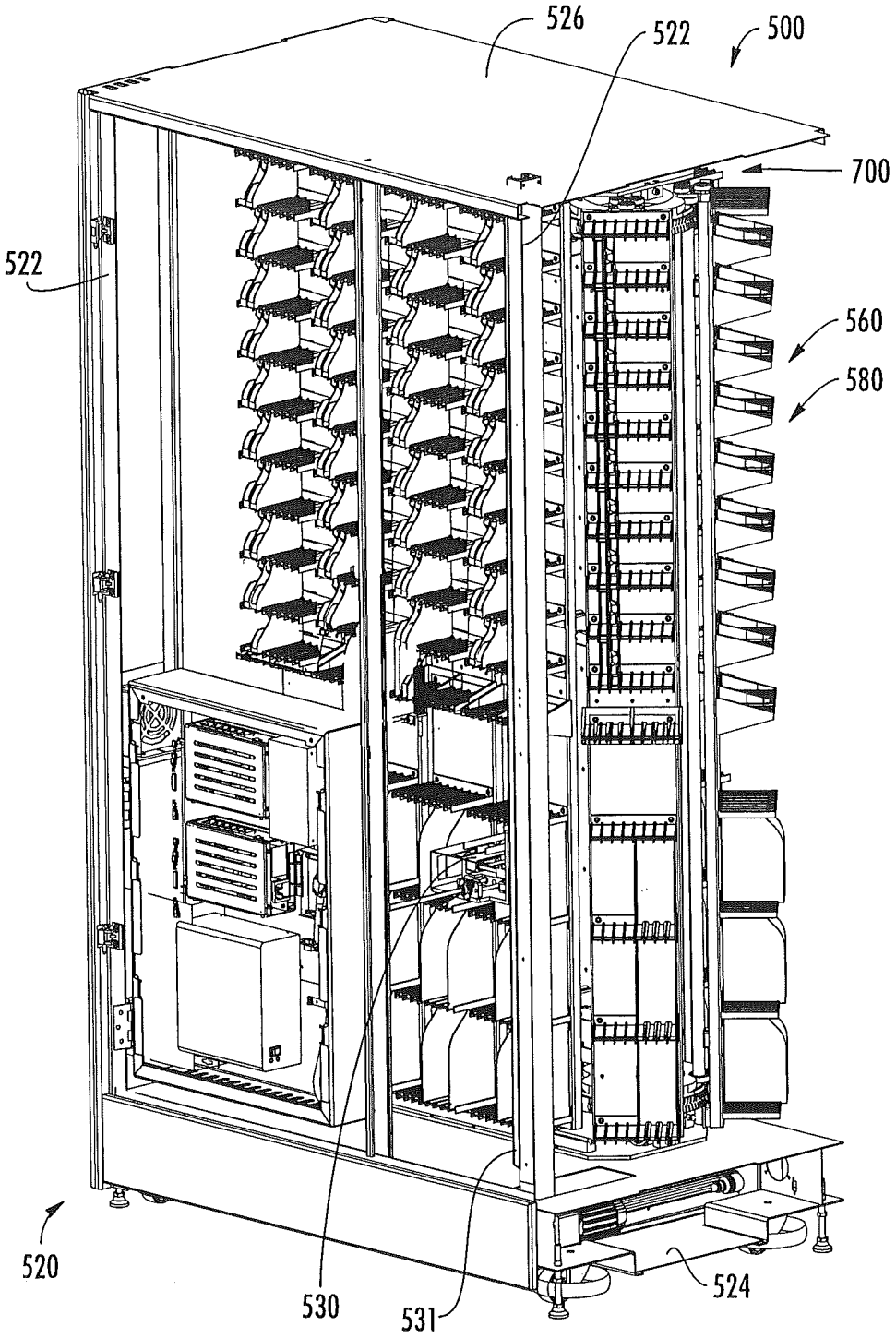
FIG. 13 is a perspective view of the system of FIG. 11 with the front and side wall removed.

Referring now to FIG. 13, the system 500 includes a frame 520 comprising upright support posts 522, a ceiling 526 and a floor 524. A carousel assembly 580 (best seen in FIGS. 14-20) is mounted to the frame 520. The carousel assembly 580 includes an endless chain of generally vertically-disposed shelf units 560 that revolve in an oblong path driven by a carousel drive assembly 700. These components are described in greater detail below.

Figure 14:
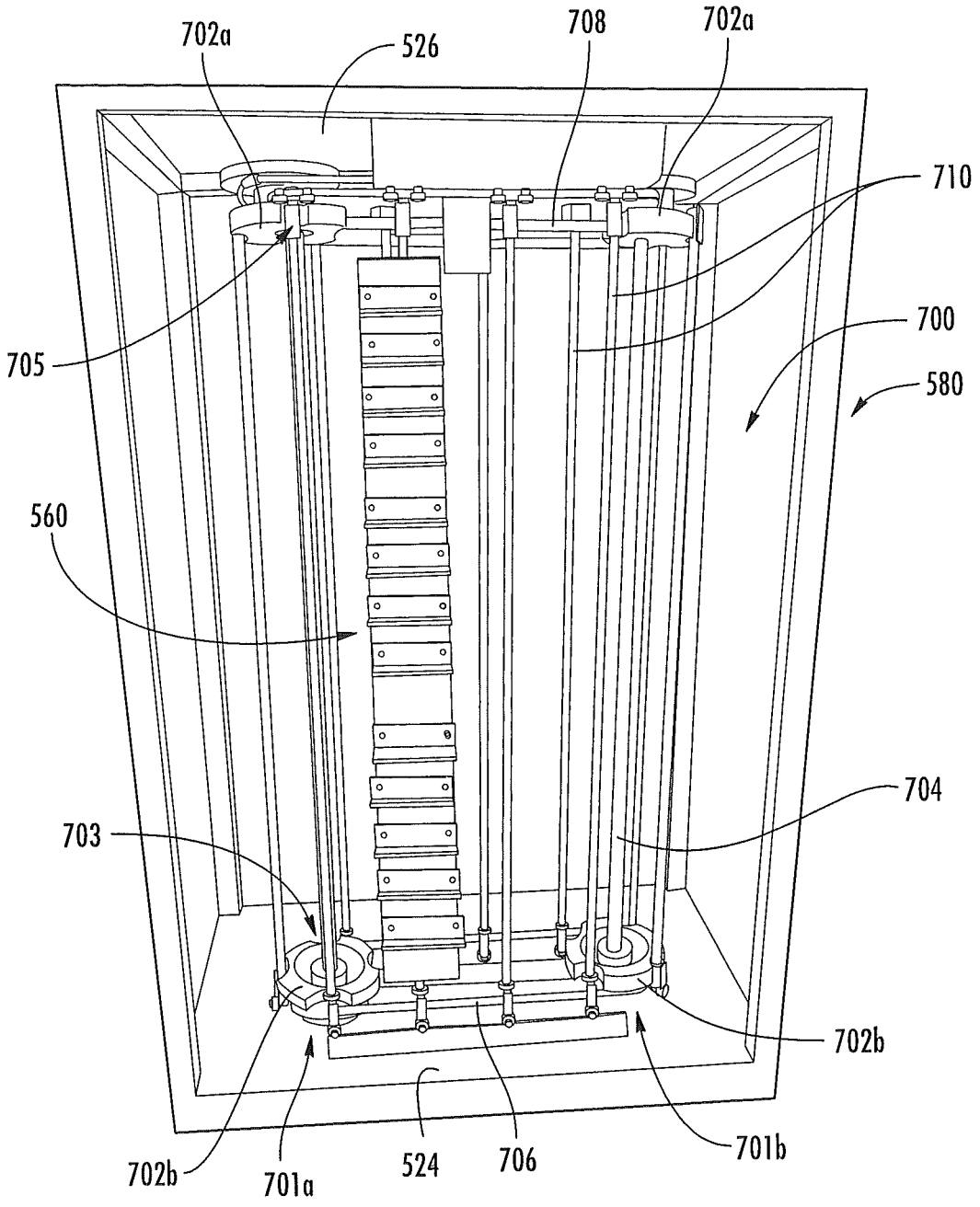
FIG. 14 is a rear perspective view of the carousel assembly and one shelf unit of the system of FIG. 11.
Figure 15:
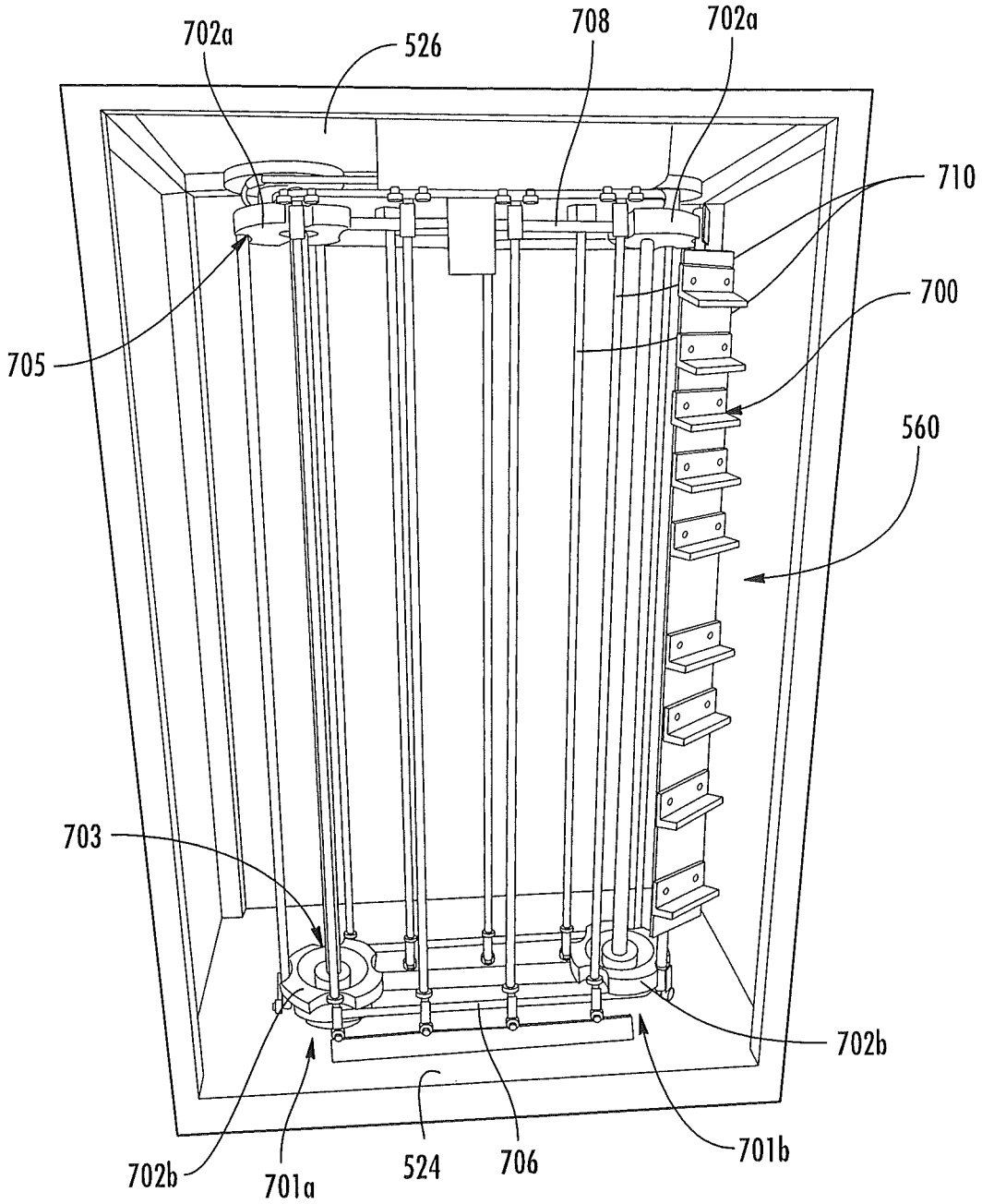
FIG. 15 is a rear perspective view of the carousel assembly and one shelf unit of the system of FIG. 11 showing the movement of the shelf unit from its position in FIG. 14.

Referring now to FIG. 14, the carousel drive assembly 700 includes two sprocket units 701*a*, 701*b*, each of which has upper and lower sprockets 702*a*, 702*b* attached to a common vertical axle 704. The lower sprockets 702*b* are rotatably mounted in the floor 524 for rotation about respective vertical axes of rotation. Similarly, the upper sprockets 702*a* are rotatably mounted in the ceiling 526. The lower sprockets 702*b* include four perimeter pockets 703 (best seen in FIGS. 19A and 19B), and the upper sprockets 702*a* include four perimeter pockets 705. A lower belt 706 engages the lower sprockets 702*b*, and an upper belt 708 engages the upper sprockets 702*a*.

Figure 16:
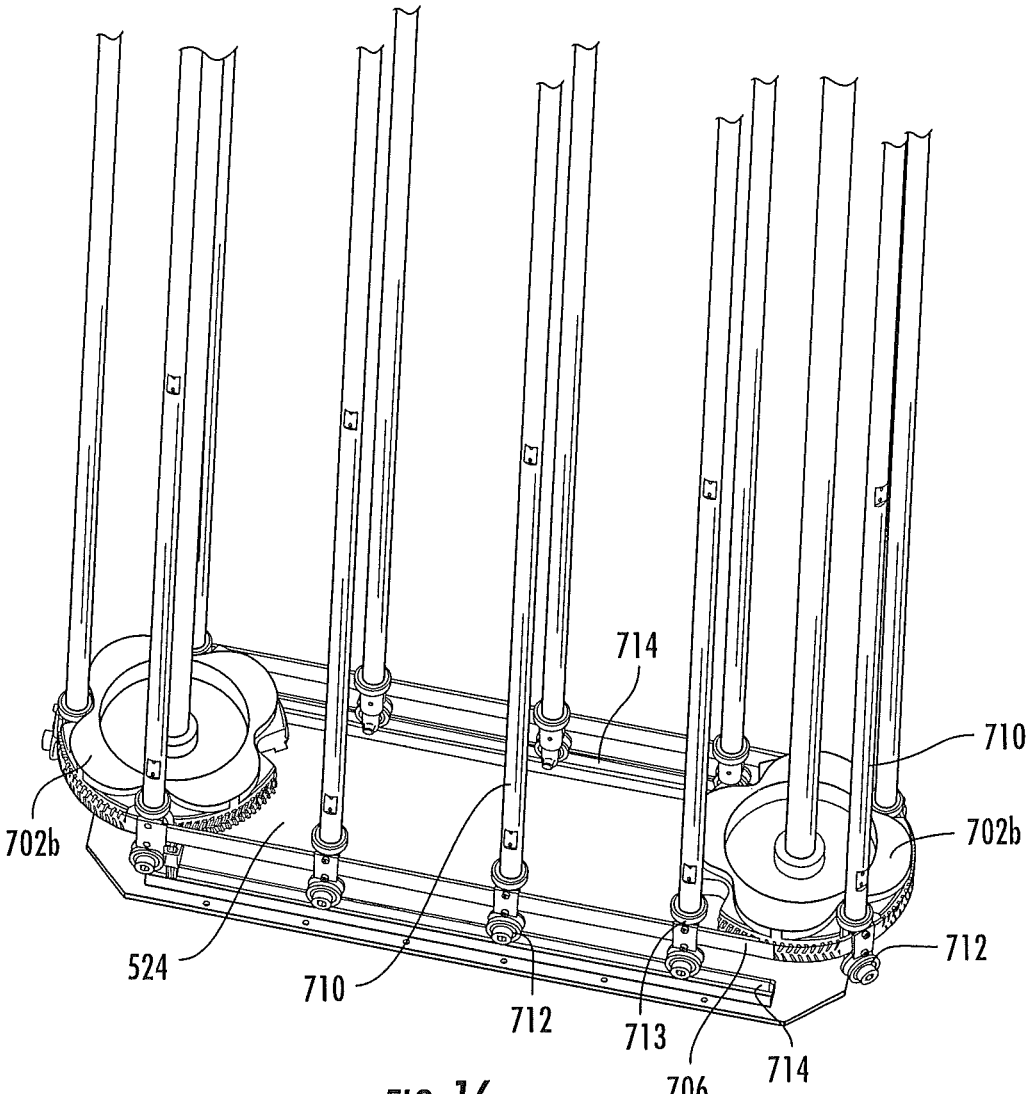
FIG. 16 is an enlarged partial rear perspective view of the carousel assembly of the system of FIG. 11.
Figure 17:
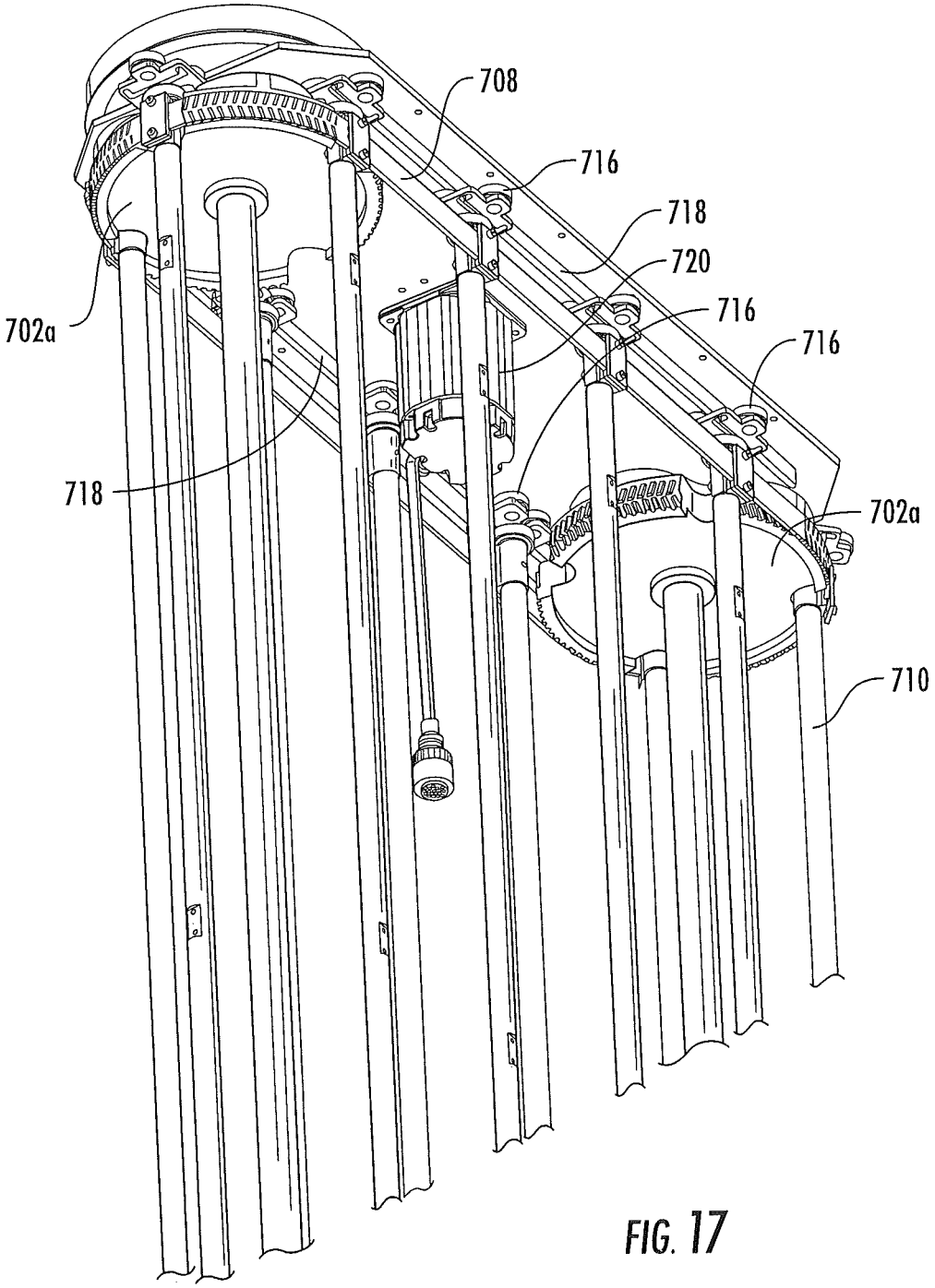
FIG. 17 is an enlarged partial bottom perspective view of the carousel assembly of the system of FIG. 11.
Figure 18:
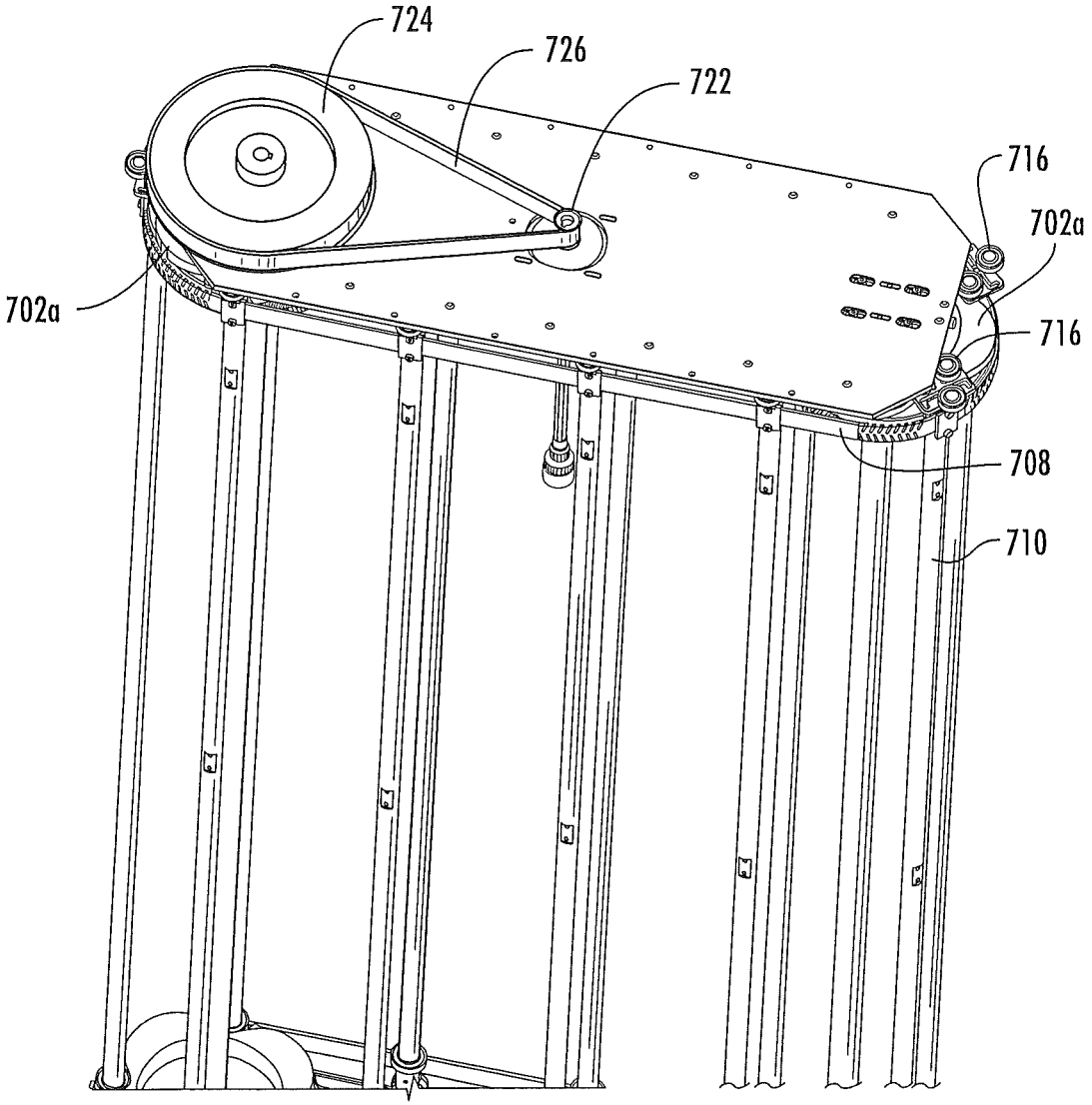
FIG. 18 is an enlarged partial top perspective view of the carousel assembly of the system of FIG. 11.
Figure 19A:
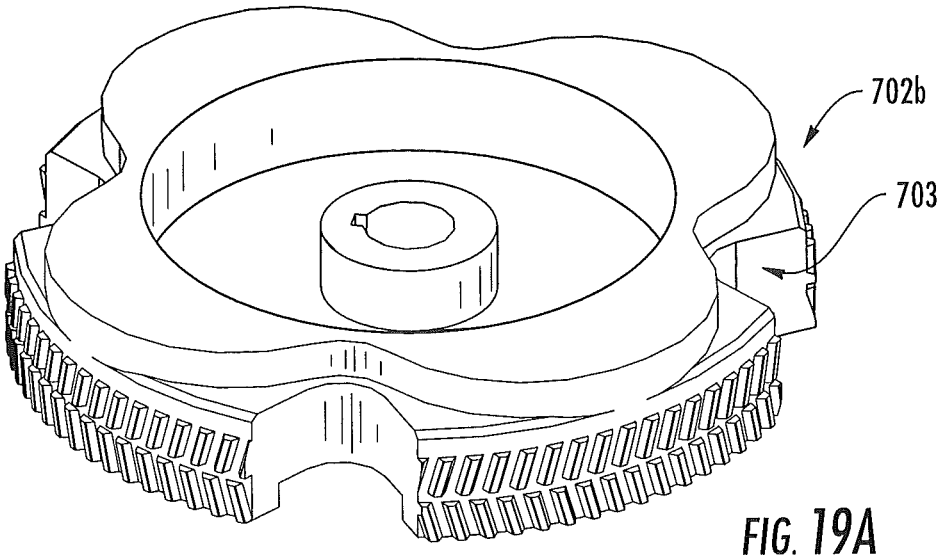
FIG. 19A is a perspective view of a lower sprocket of the carousel assembly of FIG. 14.
Figure 19B:
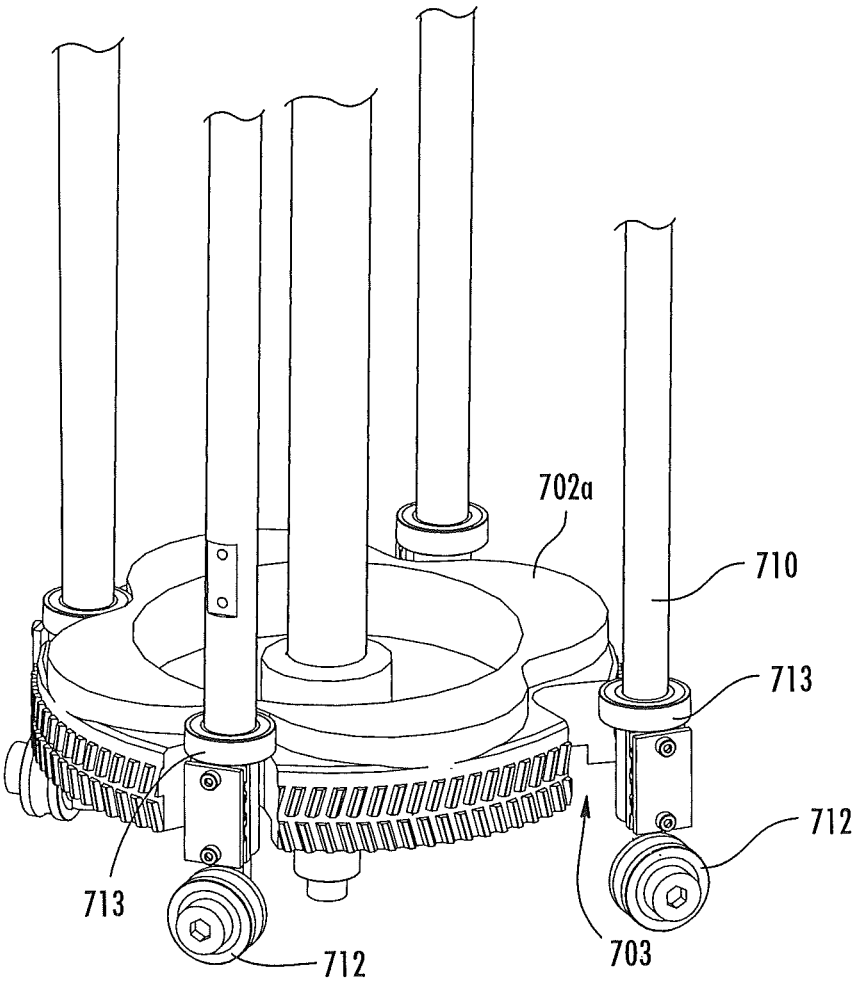
FIG. 19B is a perspective view of the lower sprocket of FIG. 19A engaged by the lower belt and rods attached thereto.

Vertical rods 710 are mounted to the radially inward surfaces of the upper and lower belts 708, 706 spaced apart several inches from each other. Referring to FIGS. 16 and 19B, at its lower end, each rod 710 attaches to a ridged wheel 712 below the lower belt 708. The wheels 712 are at a height such that the ridges of the wheels 712 can capture either of two parallel rails 714 that are mounted to the floor 524 to be generally tangential to the circumference of the lower sprockets 702*b*. A round bearing 713 is fixed to each rod 710 just above the lower belt 708. At its upper end, each rod 710 includes three horizontally disposed wheels 716 that are positioned to capture parallel rails 718 mounted on the underside of the ceiling 526 (see FIGS. 17 and 18), with two wheel 716 on the "inside" of the rail 718 and one wheel 716 on the "outside" of the rail 718.

On the lower side of the ceiling 526, a motor 720 is mounted between the upper sprockets 702*a*. The shaft of the motor 720 extends through the ceiling 526 and attaches to a small drive pulley 722 (FIG. 18). A large pulley 724 is mounted above the ceiling 526 to and coaxially with one of the upper sprockets 702*a*. A drive belt 726 engages both the drive pulley 722 and the large pulley 724. The motor 720 is connected with the controller.

Figure 20A:
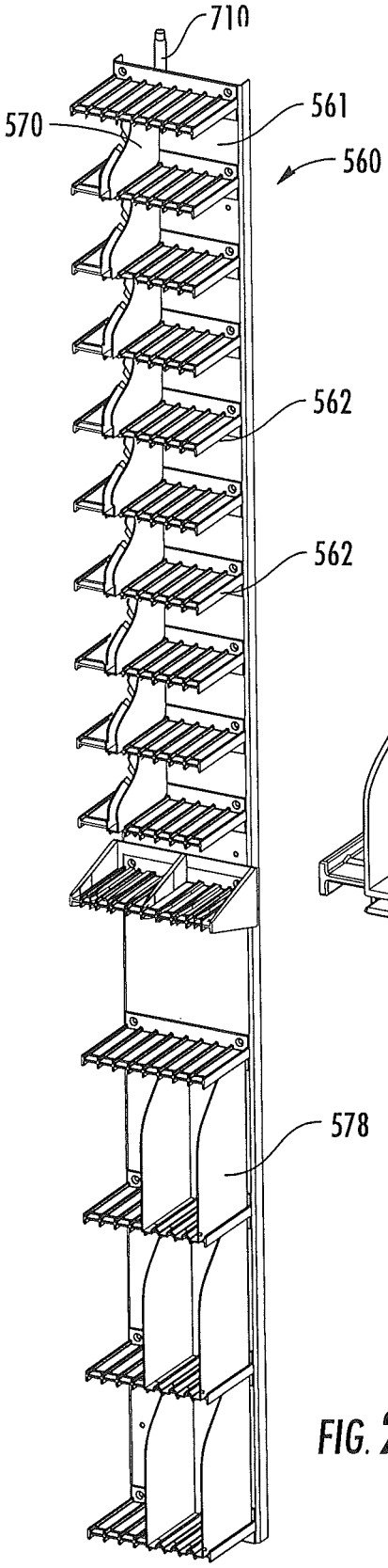
FIG. 20A is a perspective view of a shelf unit of the system of FIG. 11.
Figure 20B:
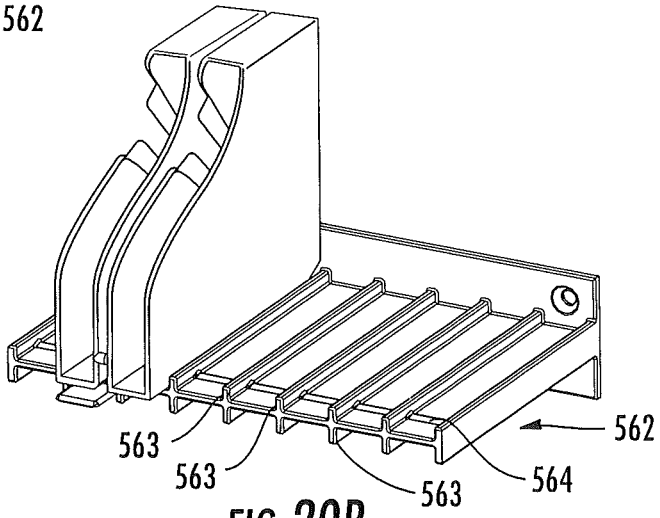
FIG. 20B is an enlarged perspective view of a single shelf of the shelf unit of FIG. 20A.
Figure 21A:
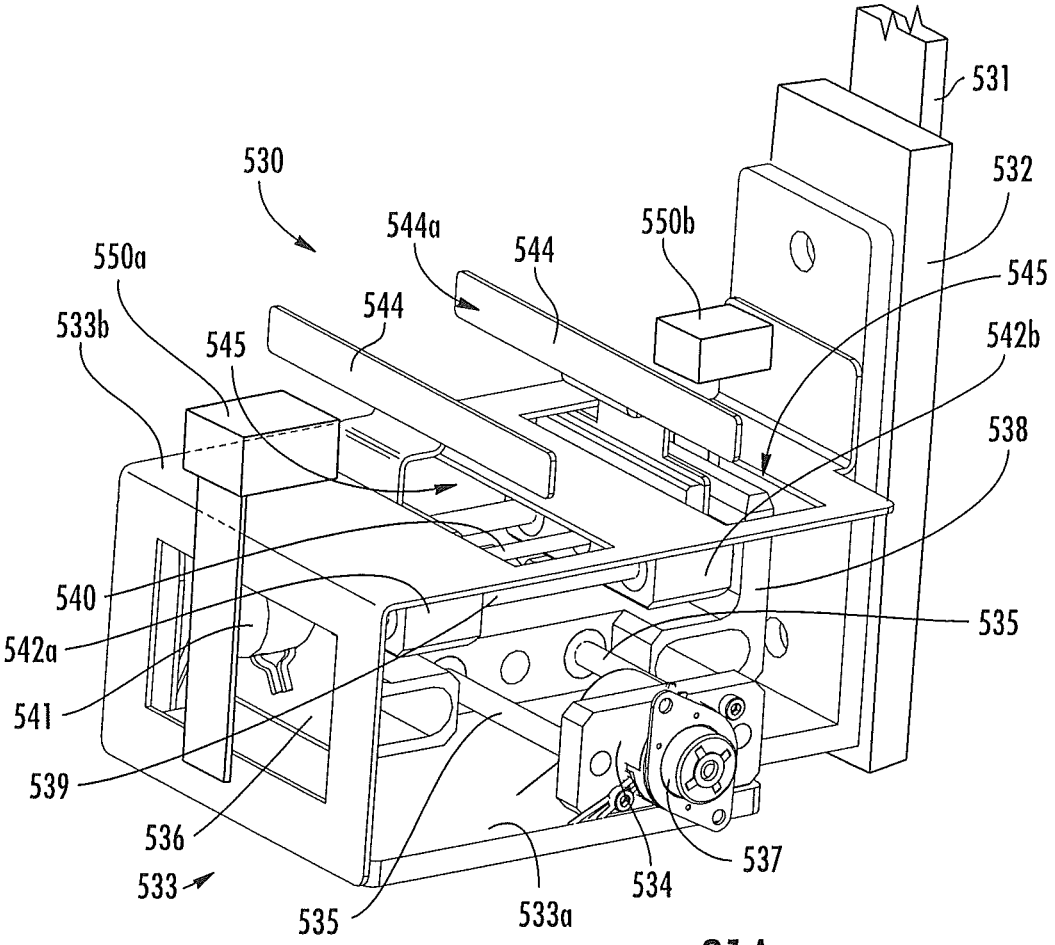
FIG. 21A is a front perspective view of the carrier assembly of the system of FIG. 11.
Figure 21B:
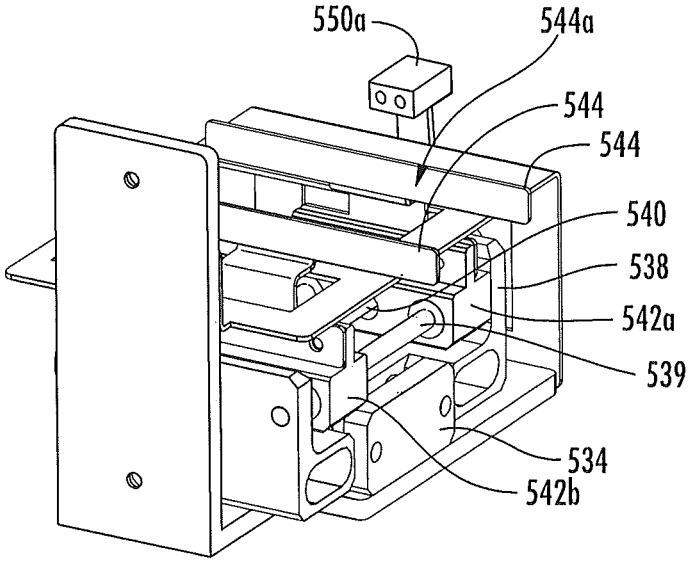
FIG. 21B is a rear perspective view of the carrier assembly of FIG. 21A.

Referring now to FIGS. 20A and 20B, each shelf unit 560 includes a rear panel 561 mounted to a respective support member in the form of a rod 710. A number of shelves 562 are mounted to each rear panel 561. Each shelf 562 has a number of raised and depending ribs 563 that divide the shelf 562. The ribs 563 are spaced such that a small bin 570 can nest between an adjacent pair of ribs 563 (see FIG. 20B), and such that a large bin 578 can fit between ribs 563 with three consecutive ribs 563 located therebetween, with the consecutive ribs 563 being received in the slots 579*a* of the large bin 578 (shown in FIG. 12B). Thus, for small bins 570 a storage location is defined between each set of adjacent ribs 563, and for large bins 580 a storage location is defined between ribs 563 separated by three consecutive ribs 563. Also, each shelf 562 includes a transverse ridge 564 that is received in the recess 576 of the small bin 570 or the recess 579*c* of the large bin 578. The transverse ridge 564 helps to maintain a small or large bin 570, 578 in place on the shelf 562 in a passive retaining system.

The carousel assembly 700 can revolve the shelf units 560 about an oblong path defined generally by the upper and lower belts 708, 706. When the shelf units 560 are to revolve, the controller signals the motor 720, which rotates the drive pulley 722. Rotation of the drive pulley 722 rotates the large pulley 724 via the drive belt 726. Because the drive pulley 724 is fixed to one of the upper sprockets 702*a*, rotation of the drive pulley 724 rotates that upper sprocket 702*a* and the remainder of the sprocket unit 701*a*. Rotation of the upper and lower sprockets 702*a*, 702*b* of the sprocket unit 701*a* causes the sprocket unit 701*b* to rotate also via the upper and lower belts 708, 706. Rotation of the sprocket units 701*a*, 701*b* drives the shelf units 560 around the oblong path noted above (see FIGS. 14 and 15).

As the shelf units 560 revolve, they are maintained on the oblong path via multiple interactions with other components. The wheels 716 capture the rails 718 on the ceiling 526 as the shelf units 560 travel along the straight portions of the oblong path to maintain the shelf units 560 in position on the path (see FIG. 17). The ridged wheels 712 ride upon the rails 714 on the floor 524 as the shelf units 560 travel along the path to maintain the vertical position of the shelf units 560 (see FIG. 16). As the shelf units 560 travel on the arcuate portions of the path, the rods 710 fit within the perimeter pockets 703 of the sprockets 702*a*, 702*b*, and the vertical position of the shelf units 560 is maintained by the interaction between the round bearings 713 and the surface of the lower sprockets 702*b* just above the pockets 703 (see FIG. 19B).

A robotic carrier unit 530 is slidably mounted via conventional construction to a vertical rail 531 located near the front of the frame 520 via a slide member 532. A base in the form of a housing 533 is mounted to the slide member 532 and includes a floor 533*a* and a ceiling 533*b*. Mounting blocks 534 are mounted to the front and rear edges of the floor 533*a* and are spanned by two slide rods 535. A carriage 536 is slidably mounted on the slide rods 535 for slidable movement thereon, driven by a motor 537 and a rack-and-pinion arrangement (not shown). The carriage 536 includes two upwardly-extending flanges 538 on which are mounted two slide rods 539. A lead screw 540 is mounted parallel to the slide rods 539 and extends through one of the flanges 538 to attached to a motor 541 mounted thereon. Two jaw blocks 542*a*, 542*b* are mounted on the slide rods 539 and the lead screw 540. A jaw 544 is mounted on each jaw block 542*a*, 542*b* and extends upwardly therefrom through an opening 545 in the ceiling 533*b* of the housing 533 with contact surfaces 544*a* of the jaws 544 being parallel and facing each other. A bar code reader 550*a* is mounted on a pedestal attached to the side wall of the housing 533, and an opposing bar code reader 550*b* is mounted on the opposite side wall of the housing 533.

The robotic carrier unit 530 has the ability to open and close the jaws 544 and to move them forwardly and rearwardly relative to the housing 533. Actuation of the motor 537 causes the rack-and-pinion mechanism to drive the carriage 536 along the slide rods 535, which in turn moves the jaws 544 forwardly or rearwardly also. Actuation of the motor 541 turns the lead screw 540, which in turn draws the jaws together or apart as desired. The controller can activate either of the motors 537, 541 as needed.

Figure 22:
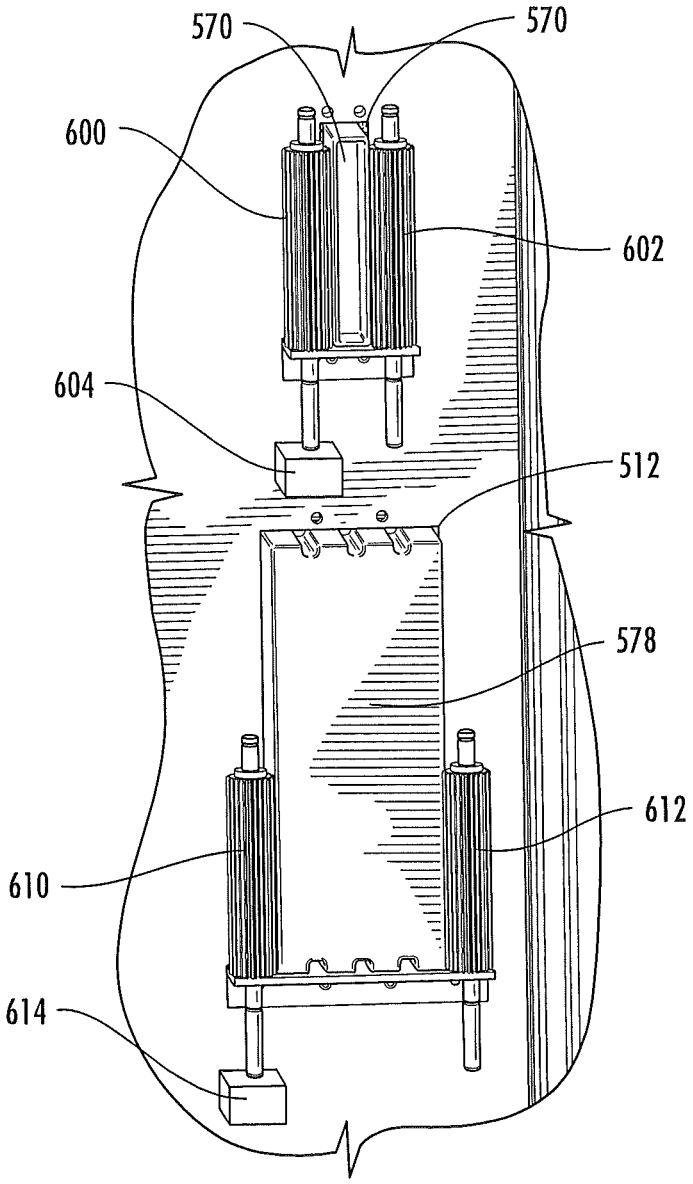
FIG. 22 is a rear view of the drive and passive rollers for the small and large dispensing windows of the system of FIG. 11.

Referring now to FIG. 22, a drive roller 600 is mounted on the rear side of the front wall 504 adjacent a side edge of the small dispensing window 510, and a complimentary passive roller 602 is mounted opposite the drive roller 600. The drive roller 600 is powered by a motor 604 controlled by the controller. Similarly, a drive roller 610 is mounted on the rear side of the front wall 504 adjacent a side edge of the large dispensing window 512, and a complimentary passive roller 612 is mounted opposite the drive roller 610. The drive roller 610 is powered by a motor 614 controlled by the controller.

To load the system 500 with single dose pharmaceutical package, a user activates the system 500 by inputting a loading command into the controller via the display screen 514. The controller locates an empty bin (either a small bin 570 or a large bin 578—for the purposes of this example, a small bin 570 will be discussed) on one of the shelves 562 of a shelf unit 560. In some embodiments, the bins in the rows closest to the small and large windows 510, 512 are kept empty whenever possible to facilitate rapid loading. If the small bin 570 selected by the controller (which could be any empty small bin 570) is not aligned already with the jaws 544 of the carrier unit 530, the controller signals the carousel drive assembly 700 to revolve the shelf units 560 until the selected bin 570 is aligned with and rearward of the jaws 544.

Figure 23A:
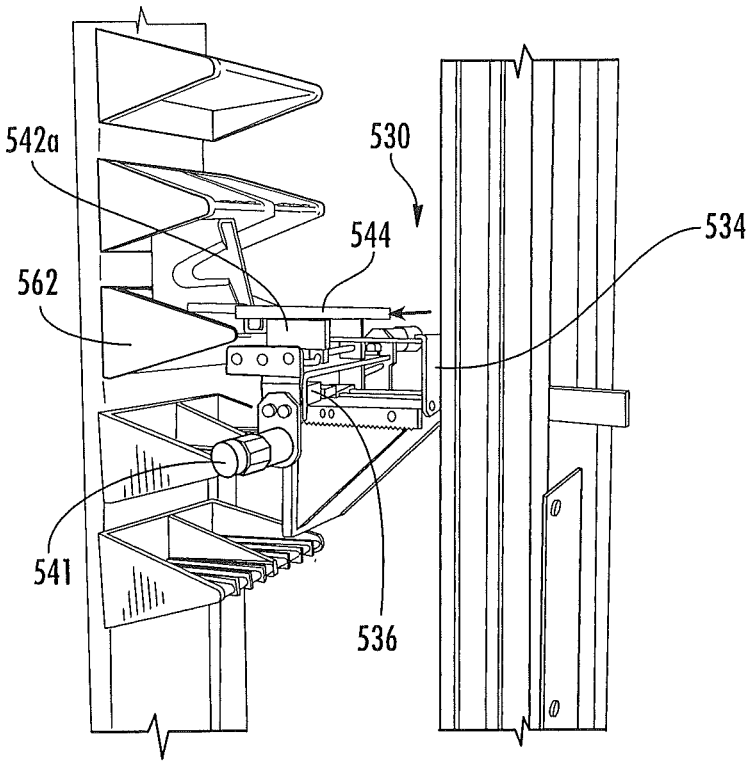
FIGS. 23A-23L are sequential views showing the transfer of a small bin from a shelf unit to the small dispensing window.
Figure 23B:
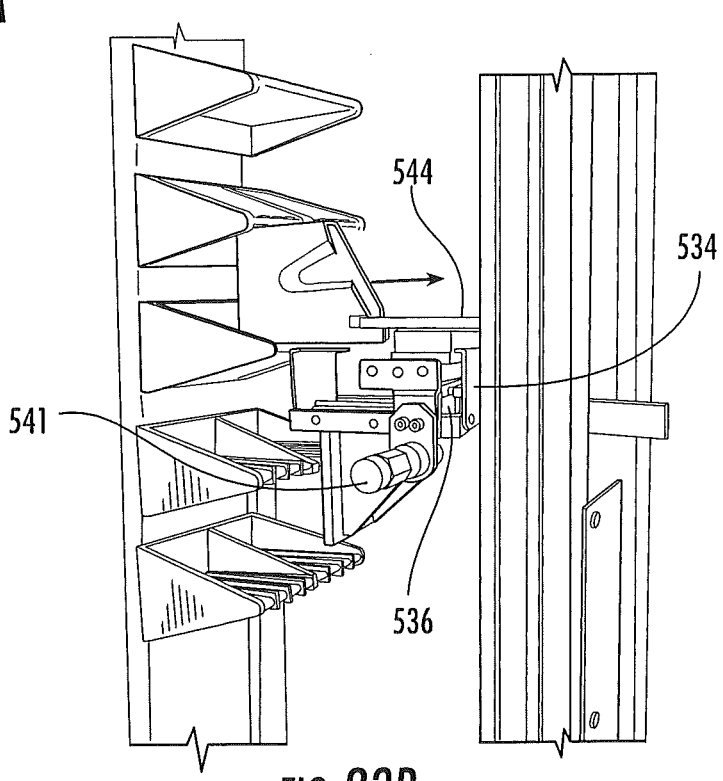
Figure 23C:
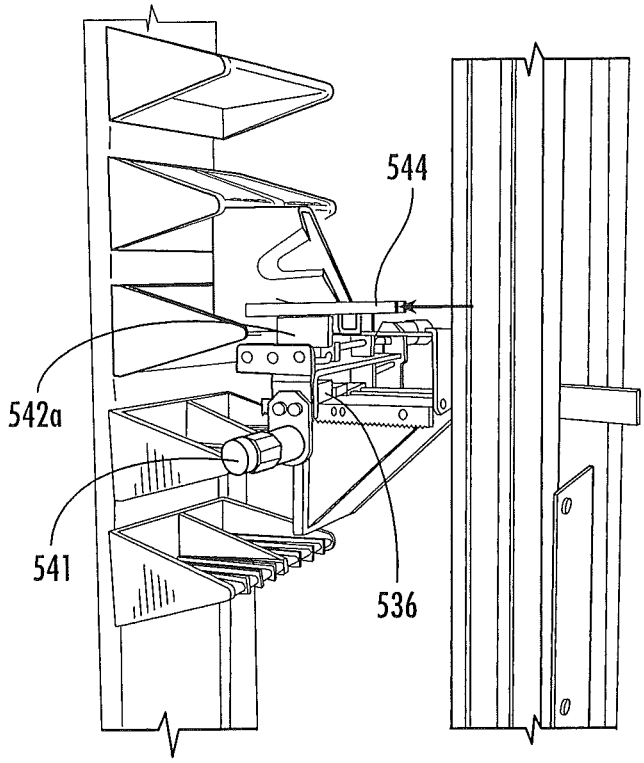
Figure 23D:
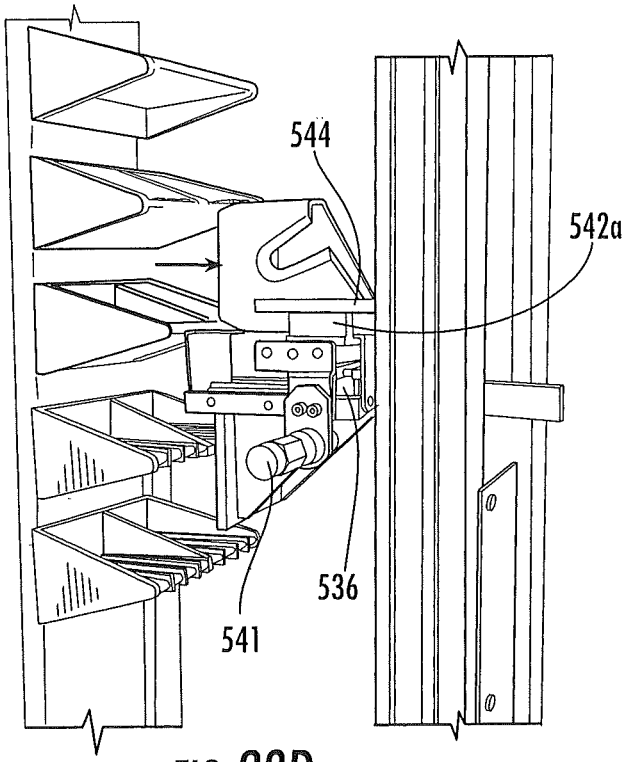
Figure 23E:
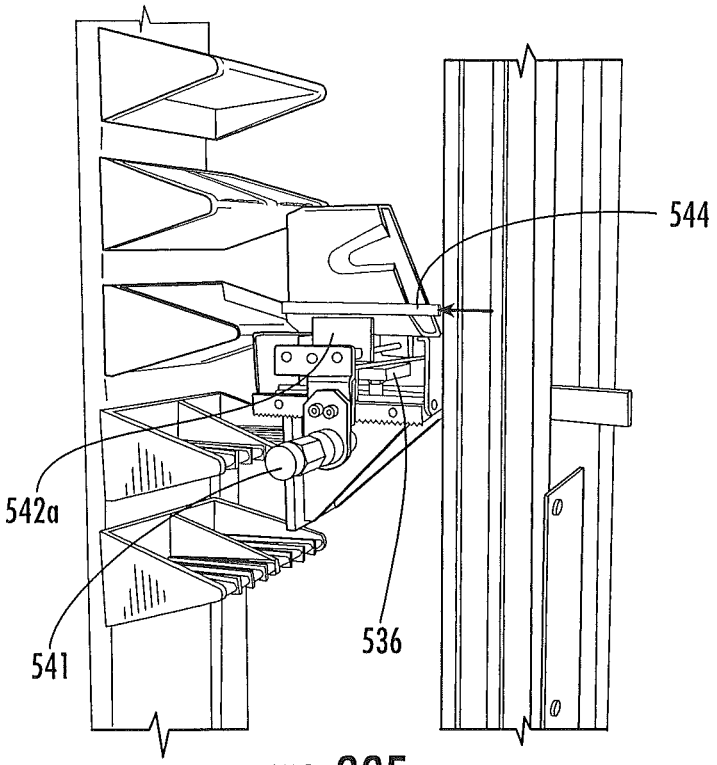
Figure 23F:
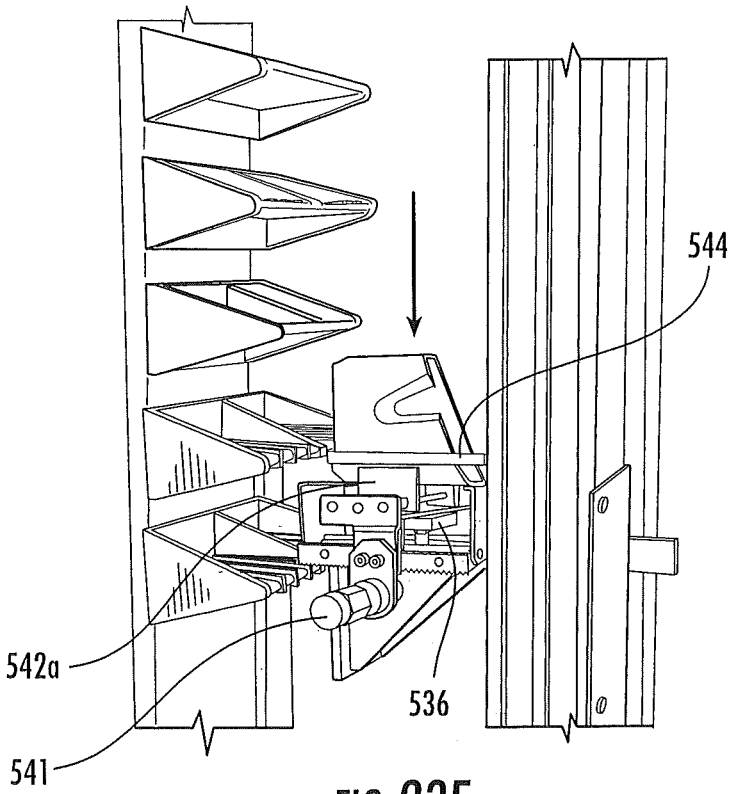
Figure 23G:
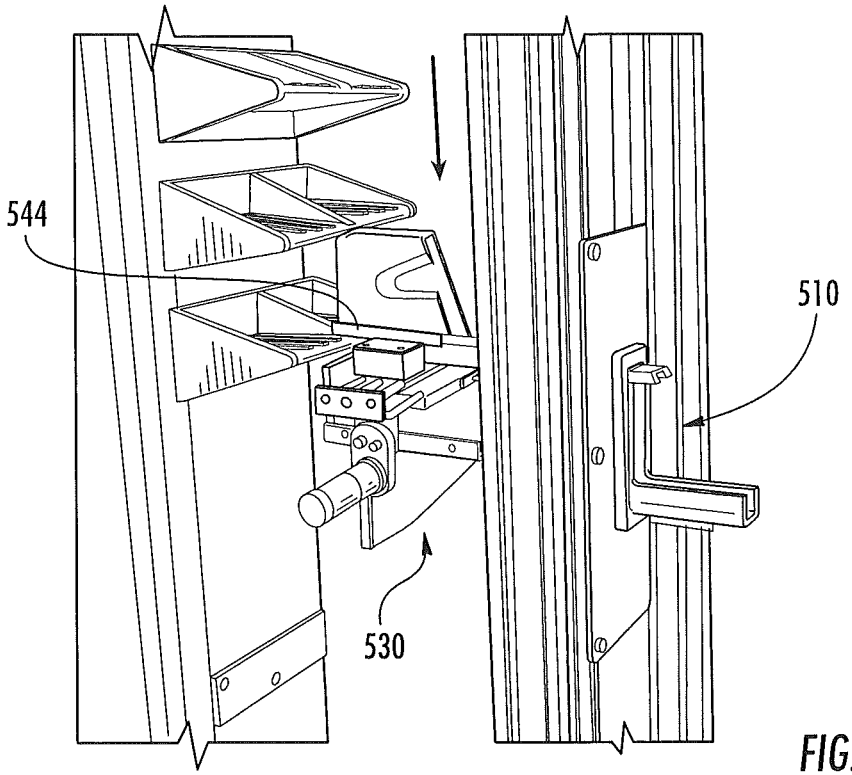
Figure 23H:
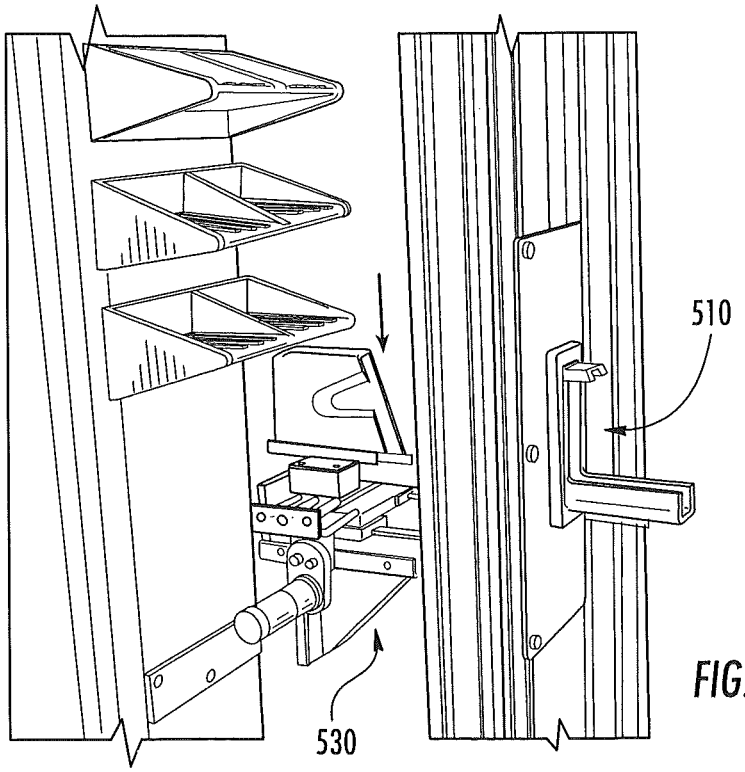

Once the bin 570 is in place, the controller signals the carrier assembly 530 to move vertically on the rail 531 to the correct height to retrieve the bin 570. As shown in FIG. 23A, the jaws 544 of the carrier assembly 530 separate and move horizontally toward the bin 570 until the rear ends of the jaws 544 are sufficiently rearward to grasp the front end of the bin 570. The controller then signals the jaws 544 to close onto the bin 570 to grasp it. The motor 537 then draws the carriage 536 forward (to the right in FIG. 23B) as the jaws 544 grasp the bin 570, thereby drawing the bin 570 forwardly and partially onto the upper surface of the ceiling 533*b*. The jaws 544 then separate and move rearwardly (driven by the motor 537 forcing the carriage 536 rearwardly) as the bin 570 rests on the ceiling 533*b* (FIG. 23C). The jaws 544 then close on the bin 570 again and move forwardly as before; in doing so, the jaws 544 "inchworm" the bin 570 forwardly (FIGS. 23D and 23E). These actions continue until the bin 570 activates a locating sensor on the jaws 544. The carrier assembly 530 moves vertically on the rail 531 until it reaches a location that positions the bin 570 approximately level with the small window 510 (FIGS. 23F-23H).

Figure 23I:
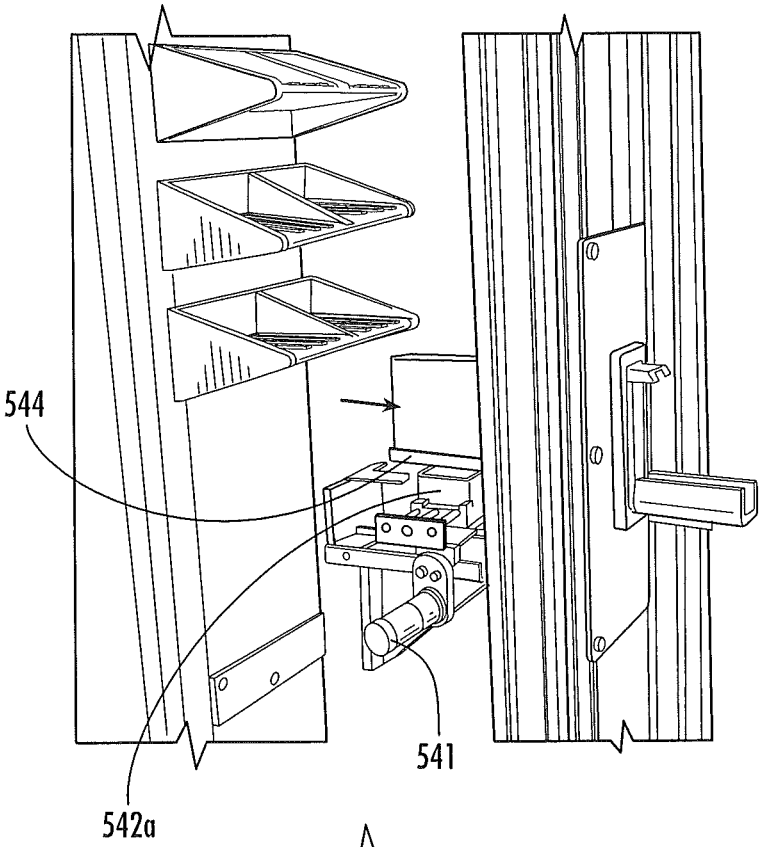
Figure 23J:
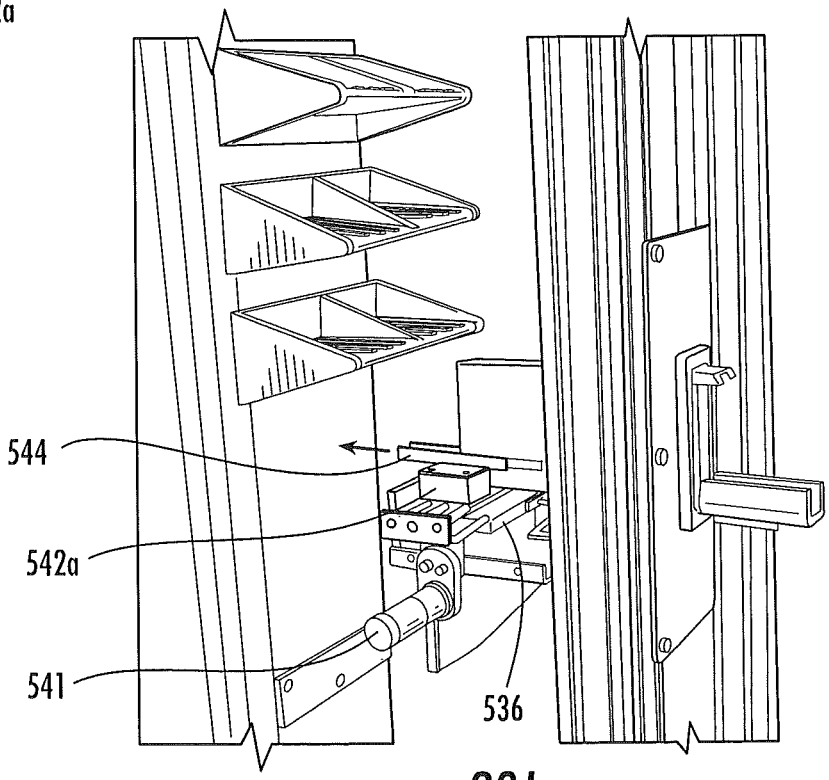
Figure 23K:
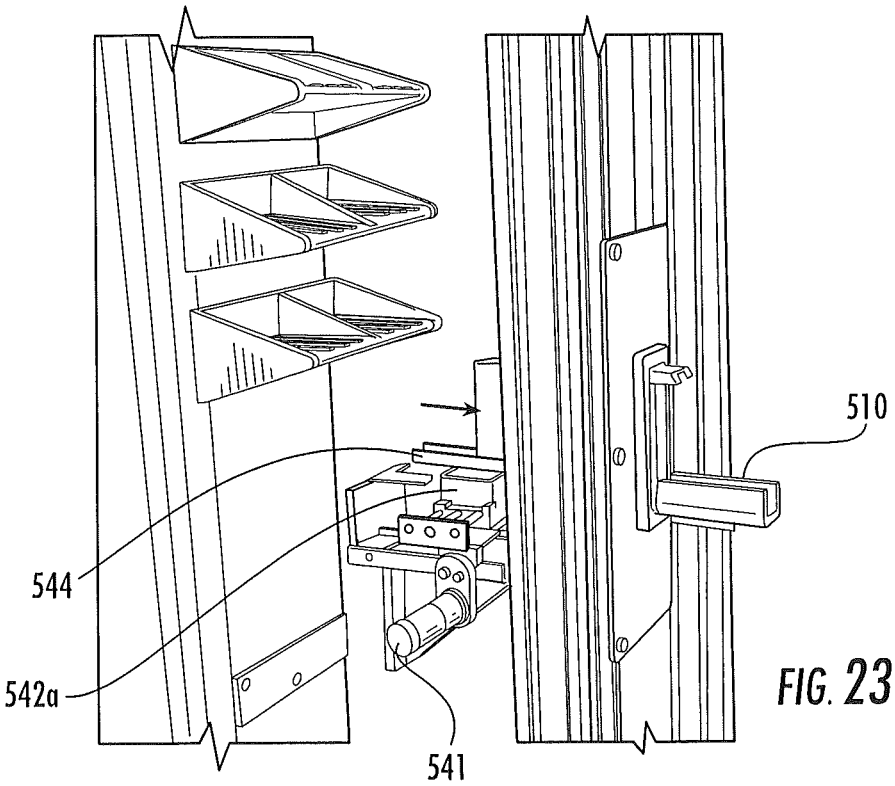
Figure 23L:
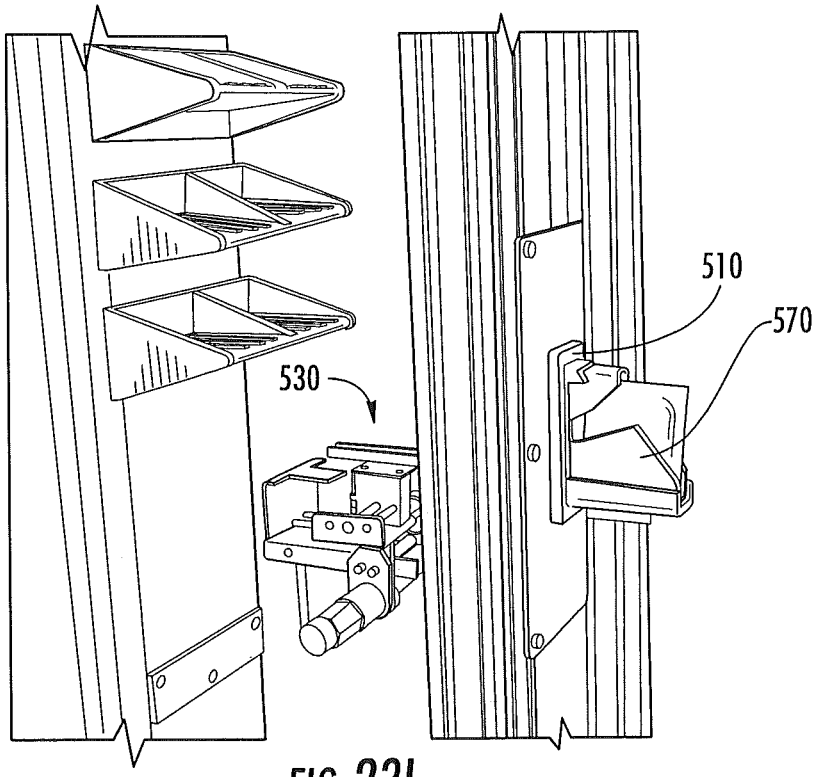

Once in position adjacent the small window 510, the door opens, the jaws 544 move forwardly, separate, move rearwardly, close on the small bin 570, and move forwardly again (FIGS. 23I-23K). Repetition of this movement positions the bin 570 with its front edge adjacent the drive roller 600 and the passive roller 602. The motor 604 rotates the drive roller 600, which drives the bin 570 through the small dispensing window 510 and onto the stage 511 (FIG. 23L). The small bin 570 is captured within the small dispensing window 510 by the rim 511*b* of the stage 511*a*, which prevents the small bin 570 from being removed from the small dispensing window 510. From this position, the empty small bin 570 can be loaded with a single dose pharmaceutical package or blister pack.

The operator may scan the package with the bar code scanner 516 prior to loading the package into the small bin 570, or may place the package directly into the small bin 570. As described above, the package is generally vertically disposed in the small bin 570; if the package is a blister-pack, the "blister" resides in the slot 576 in the manner shown in FIG. 12C. In either event, the package is positioned therein such that a bar code affixed thereto is located below the slot 576 for reading by one of the bar code readers 550*a*, 550*b*.

After the small bin 570 is loaded with the pharmaceutical package, the controller signals the system 500 to reverse the steps described above in connection with the presentation of the small bin 570. More specifically, the drive roller 600 rotates to draw the small bin 570 back through the small dispensing window 510 until locating sensors in the jaws 544 detect the presence of the small bin 570 in position between the jaws 544. The jaws 544 close to grasp the bin 570 and move rearwardly to "inch" the package rearwardly. The jaws 544 then separate, move forwardly to center the jaws 544 on the bin 570, and close to grasp the bin 570. The carrier assembly 530 then moves vertically on the rail 531 to position the bin 570 at the proper height for loading onto the selected shelf 562. Under most circumstances, the carrier assembly 530 will simply return the small bin 570 to the location on the shelf 562 that it just vacated prior to loading; however, another storage location may be selected, in which case the controller activates the carousel assembly 700 to rotate the shelf unit 560 having the selected shelf 562 to a position in line with the jaws 544:

When the carrier assembly 530 and the shelf 562 are both in position, the controller signals the carrier assembly 530 to load the bin 570 into the selected storage location. The jaws 544 move rearwardly, separate, move forwardly, close onto the bin 570, and move rearwardly with the bin 570. This process is repeated until the carrier assembly locating sensors have been deactivated (with the bin 570 resting on either the ceiling 533*b* of the housing 533 or the shelf 562, depending on how far rearwardly the bin 570 has moved) to "inch" the bin 570 into place in the selected location on the shelf 562. The small bin 570 is retained in place by the interaction between the ridge 564 of the shelf and the recess 573*a* of the small bin 570.

One additional step that may be performed during loading of the pharmaceutical package onto a storage location on a shelf 562 is reading of the bar code on the package by one of the bar code readers 550*a*, 550*b*. The bar code, which may be one- or two-dimensional, typically includes information about the pharmaceutical in the package, such as the NDC number, dosage or the like, that enables the system 500 to track the type of pharmaceutical being stored in a particular storage location.

To dispense a desired pharmaceutical, the controller simply identifies a storage location that contains the package of interest, then moves the carousel assembly 580 and the carrier assembly 530 as described above to move the bin 570 and carrier assembly 530 to a position in which the carrier assembly can retrieve the bin 570. The carrier assembly 530 then moves the bin 570 to the dispensing window 510 in the manner described above in connection with FIGS. 23A-23L. In many instances, the bar code reader 550*a*, 550*b* will read the bar code on the package to confirm the identity of the pharmaceutical contained in the package. Once the small bin 570 and its package reach the small dispensing window 510, the package can be removed from the bin 570. The small bin 570 can then either be loaded with a different package or can be returned empty to its storage location.

A similar sequence of steps would be followed for the loading, storage, and dispensing of pharmaceutical items in a large bin 578, with the exceptions that (a) the large bin 578 would be presented to and withdrawn from the large dispensing window 512, and (b) in some cases the form of the package will not make it possible for the bar code scanner 550*a*, 550*b* to read the bar code on the package, so identification and confirmation of the package contents is typically performed at the bar code reader 516.

The system 500 typically stores data associated with the storage and dispensing of pharmaceutical packages therein. As a result, the system 500 can provide reports (either on the display screen 514 or in hard-copy form) of inventory, dispensing, timing, and the like as described in some detail above in connection with the systems 100, 300 and 400.

Those skilled in this art will appreciate that the system 500 may take various other forms. For example, the motors and slide rods of the carrier assembly that control movement of the jaws 544 may be replaced with different varieties of drive units such as belt drives, conveyors, roller assemblies cam drives, and the like. Also, the rollers 600, 602, 610, 612 may be omitted, or in some embodiments may be incorporated into the carrier assembly.

Some embodiments of the system may have only one dispensing window, or may have more than two dispensing windows. In single window embodiments, the window may be of a single permanent size, or may be configured to expand or contract between multiple sizes based on the size of the bin being used for storage or dispensing.

Similarly, the shelf units 560 may have only one size of shelf, or may have more than two sizes. Moreover, the shelf units may be deployed such that one or more shelf units includes shelves intended to house only one size of bin, and one or more other shelf units includes shelves intended to house only a different size of bin. Rather than the passive bin retaining system provided by the recesses in the bins and the ridges in the shelves, the shelf units may employ an active retaining system that includes springs, latches, magnets, doors, locks, clips or the like. In addition, the carousel assembly may be constructed differently, with sprockets that lack perimeter pockets (e.g., the rods may be mounted on the outer surface of the upper and lower belts), or with a path that is defined differently (including round). Other variations may also be suitable for use with the system.

Also, although blister-packs and pouches are shown herein as pharmaceutical dose packages, other forms of packaging may also be used, including envelopes, boxes, jars, vials, "bingo cards" (blister pack cards), and the like.

Those skilled in this art will also appreciate that features described above in connection with the systems 100, 300 and 400, such as refrigeration, security, and the like, may also be employed with the system 500.

The foregoing embodiments are illustrative of the present invention, and are not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention.

That which is claimed is:

1. A method of storing and dispensing discrete doses of pharmaceuticals, comprising:

(a) providing a system for storing and dispensing discrete doses of pharmaceuticals, the system comprising:
- a housing with an internal cavity having a front wall with first and second windows;
- multiple storage locations positioned within the housing rearwardly of the front wall;
- a carrier assembly positioned and movable within the housing; and
- a plurality of bins, each of the bins having an open front end and a storage volume rearwardly of the front end and residing in one of the storage locations;

(b) loading a pharmaceutical dose package into a first bin, the open end of the first bin extending partially forwardly of and captured by one of the first and second windows, the open end of the bin being generally parallel to the front wall of the housing;

(c) using the carrier assembly, conveying the first bin with the pharmaceutical dose package from the first or second window to a first one of the storage locations;

(d) using the carrier assembly, depositing the first bin and the pharmaceutical dose package in the first storage location;

(e) using the carrier assembly, retrieving the first bin and the pharmaceutical dose package from the first storage location responsive to a user request;

(f) using the carrier assembly, conveying the first bin and the pharmaceutical dose package to the first or second window, such that the open end of the first bin extends partially in front of the first or second window, the open end of the bin being generally parallel to the front wall of the housing; and (g) removing the pharmaceutical dose package from the first bin as the open end of the first bin extends partially in front of the first or second window.

2. The method defined in claim 1, wherein the second window is of a different size than the first window.

3. The method defined in claim 2, wherein the multiple storage locations comprise first and second sets of storage locations, the first set of storage locations being configured to store a bin of a different size than the second set of storage locations.

4. The method defined in claim 3, wherein the plurality of bins is divided into first and second sets of bins, wherein the first set of bins is sized and configured to reside in one of the first set of storage locations and be conveyed by the carrier assembly between the first storage location and the first window, and wherein the second set of bins is sized and configured to reside in one of the second set of storage locations and be conveyed by the carrier assembly between the second storage location and the second window.

5. The method defined in claim 1, wherein each of the plurality of bins includes a rim that is captured by the first or second window in steps (b) and (g).

6. The method defined in claim 1, wherein the carrier includes a bar code scanner, and further comprising the step of scanning a bar code on the pharmaceutical dose package during one of steps (c) and (f).

7. The method defined in claim 1, wherein the pharmaceutical close package extends through the open front end of the bin during steps (c)-(f).

8. A method of storing and dispensing discrete doses of pharmaceuticals, comprising:

(a) providing a system for storing and dispensing discrete doses of pharmaceuticals, the system comprising:
- a housing with an internal cavity having a front wall with a first window;
- multiple storage locations positioned within the housing rearwardly of the front wall;
- a carrier assembly positioned and movable within the housing; and
- a plurality of bins, each of the bins having an open front end and a storage volume rearwardly of the front end and residing in one of the storage locations;

(b) loading a pharmaceutical dose package into a first bin, the open end of the first bin extending partially forwardly of and captured by the first window, the open end of the bin being generally parallel to the front wall of the housing;

(c) using the carrier assembly, conveying the first bin with the pharmaceutical dose package from the first window to a first one of the storage locations;

(d) using the carrier assembly, depositing the first bin and the pharmaceutical dose package in the first storage location;

(e) using the carrier assembly, retrieving the first bin and the pharmaceutical dose package from the first storage location responsive to a user request;

(f) using the carrier assembly, conveying the first bin and the pharmaceutical dose package to the first window, such that the open end of the first bin extends partially in front of the first window, the open end of the bin being generally parallel to the front wall of the housing; and (g) removing the pharmaceutical dose package from the first bin as the open end of the first bin extends partially in front of the first window.

9. The method defined in claim 8, wherein the multiple storage locations comprise first and second sets of storage locations, the first set of storage locations being configured to store a package of a different size than the second set of storage locations.

10. The method defined in claim 9, further comprising a plurality of bins divided into first and second sets of bins, wherein the first set of bins is sized and configured to reside in one of the first set of storage locations and be conveyed by the carrier assembly between the first storage location and the first window, and wherein the second set of bins is sized and configured to reside in one of the second set of storage locations and be conveyed by the carrier assembly between the second storage location and a second window.

11. The method defined in claim 8, wherein each of the plurality of bins includes a rim that is captured by the first window in steps (b) and (g).

12. The method defined in claim 8, wherein the carrier includes a bar code scanner, and further comprising the step of scanning a bar code on the pharmaceutical dose package during one of steps (c) and (f).

13. A method of storing and dispensing discrete doses of pharmaceuticals, comprising:

(a) providing a system for storing and dispensing discrete doses of pharmaceuticals, the system comprising:
- a housing with an internal cavity having a front wall with a first window;
- multiple storage locations positioned within the housing rearwardly of the front wall;
- a carrier assembly positioned and movable within the housing; and
- a plurality of bins, each of the bins having an open front end and a storage volume rearwardly of the front wall and residing in one of the storage locations;

(b) loading a pharmaceutical dose package into a first bin, the open end of the first extending partially forwardly of and captured by the first window, the open end of the bin being generally parallel to the front wall of the housing;

(c) using the carrier assembly, conveying the first bin with the pharmaceutical dose package from the first window to a first one of the storage locations;

(d) scanning a bar code on the pharmaceutical dose package with a bar code scanner located on the carrier assembly;

(e) using the carrier assembly, depositing the first bin and the pharmaceutical dose package in the first storage location;

(f) using the carrier assembly, retrieving the first bin and the pharmaceutical dose package from the first storage location responsive to a user request;

(g) using the carrier assembly, conveying the first bin and the pharmaceutical dose package to the first window, such that the open end of the first bin extends partially in front of the first window, the open end of the bin being generally parallel to the front wall of the housing; and (h) removing the pharmaceutical dose package from the first bin as the open end of the first bin extends partially in front of the first window.

14. The method defined in claim 13, wherein step (d) occurs during at least one of steps (c) and (g).

15. The method defined in claim 14, wherein step (d) occurs during step (c), and further comprising scanning the bar code on the pharmaceutical dose package a second time during step (g).

16. The method defined in claim 13, wherein the multiple storage locations comprise first and second sets of storage locations, the first set of storage locations being configured to store a package of a different size than the second set of storage locations.

17. The method defined in claim 16, further comprising a plurality of bins divided into first and second sets of bins, wherein the first set of bins is sized and configured to reside in one of the first set of storage locations and be conveyed by the carrier assembly between the first storage location and the first window, and wherein the second set of bins is sized and configured to reside in one of the second set of storage locations and be conveyed by the carrier assembly between the second storage location and a second window.

18. A method of storing and dispensing discrete doses of pharmaceuticals, comprising:

(a) providing a system for storing and dispensing discrete doses of pharmaceuticals, the system comprising:

a housing with an internal cavity having a front wall with a first window;

multiple storage locations positioned within the housing;

a carrier assembly positioned and movable within the housing; and a plurality of bins, each of the bins having an open front end and residing in one of the storage locations;

(b) loading a pharmaceutical dose package into a first bin extending partially forwardly of and captured by the first window;

(c) using the carrier assembly, conveying the first bin with the pharmaceutical dose package from the first window to a first one of the storage locations;

(d) using the carrier assembly, depositing the first bin and the pharmaceutical dose package in the first storage location;

(e) using the carrier assembly, retrieving the first bin and the pharmaceutical dose package from the first storage location responsive to a user request;

(f) using the carrier assembly, conveying the first bin and the pharmaceutical dose package to the first window, such that the first bin extends partially in front of the first window; and (g) removing the pharmaceutical dose package from the first bin as it extends partially in front of the first window;

wherein the pharmaceutical dose package extends through the open front end of the bin during steps (c)-(f).

* * * * *